US008157535B2

(12) United States Patent
Wang et al.

(10) Patent No.: US 8,157,535 B2
(45) Date of Patent: Apr. 17, 2012

(54) ELECTRICAL AIR PUMP ASSEMBLY AND INFLATABLE PRODUCT HAVING THE SAME

(75) Inventors: Cheng-Chung Wang, Taipei (TW); Kenneth Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 894 days.

(21) Appl. No.: 12/174,606

(22) Filed: Jul. 16, 2008

(65) Prior Publication Data

US 2010/0014993 A1 Jan. 21, 2010

(51) Int. Cl.
*F04B 49/00* (2006.01)

(52) U.S. Cl. ..... 417/26; 417/44.1

(58) Field of Classification Search ..... 417/234, 417/315, 26, 44.1; 5/713, 706, 708, 710; 137/560; 251/289
See application file for complete search history.

(56) References Cited

U.S. PATENT DOCUMENTS

| | | | | |
|---|---|---|---|---|
| 4,829,616 | A * | 5/1989 | Walker | 5/713 |
| 2004/0168256 | A1* | 9/2004 | Chaffee | 5/713 |
| 2006/0085918 | A1* | 4/2006 | Metzger | 5/713 |

* cited by examiner

*Primary Examiner* — Devon C Kramer
*Assistant Examiner* — Dnyanesh Kasture

(57) ABSTRACT

An inflatable product includes an inflatable body having an exterior wall defining at least one air chamber therein, at least one electrical air pump unit, an electrical switch connected electrically to the electrical air pump unit, and at least one controller. The controller is operable manually to activate the electrical air pump unit so as to perform a selected one of inflation, full deflation, and partial deflation of the air chamber in the inflatable body.

6 Claims, 23 Drawing Sheets

ELECTRICAL AIR PUMP ASSEMBLY AND INFLATABLE PRODUCT HAVING THE SAME

BACKGROUND OF THE INVENTION

1. Field of the Invention

This invention relates to an electrical air pump assembly operable manually to perform inflation and full deflation of at least one air chamber in an inflatable product, and partial deflation of at least one air chamber in the inflatable product through unaided exhaust of air through a valve opening.

2. Description of the Related Art

A conventional inflatable bed includes a plurality of interconnected mattresses for supporting the head and the body of the bed occupant. The mattresses can be inflated simultaneously by an electric air pump. As a result, the mattresses have the same softness at all areas of the inflatable bed. To enhance user comfort, however, it is necessary for such mattresses to provide different levels of softness at different areas of the inflatable bed.

SUMMARY OF THE INVENTION

The object of this invention is to provide an electrical air pump assembly operable manually to perform inflation, partial deflation, and full deflation of at least one air chamber in an inflatable product.

According to an aspect of this invention, there is provided an electrical air pump assembly adapted for use with an inflatable product, the inflatable product having an inflatable body having an exterior wall defining at least one air chamber therein, the electrical air pump assembly comprising:

at least one electrical air pump unit;

an electrical switch connected electrically to the electrical air pump unit; and at least one controller operable manually to activate the electrical air pump unit so as to perform a selected one of inflation, partial deflation, and full deflation of the air chamber in the inflatable body.

According to another aspect of this invention, there is provided an inflatable product comprising:

an inflatable body having an exterior wall defining at least one air chamber therein;

at least one electrical air pump unit;

an electrical switch connected electrically to the electrical air pump unit; and at least one controller operable manually to activate the electrical air pump unit so as to perform a selected one of inflation, partial deflation, and full deflation of the air chamber in the inflatable body.

According to still another object of this invention, there is provided an inflatable product comprising:

an inflatable body having an exterior wall defining at least one air chamber therein;

at least one electrical air pump unit formed with at least one air inlet and at least one air outlet;

an electrical switch connected electrically to the electrical air pump unit; and at least one controller built in the inflatable body, and having a portion exposed outwardly of the inflatable body;

wherein the controller is operable manually to control activation and deactivation of the electrical switch so as to perform at least one of inflation, full deflation, and partial deflation of the air chamber in the inflatable body.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
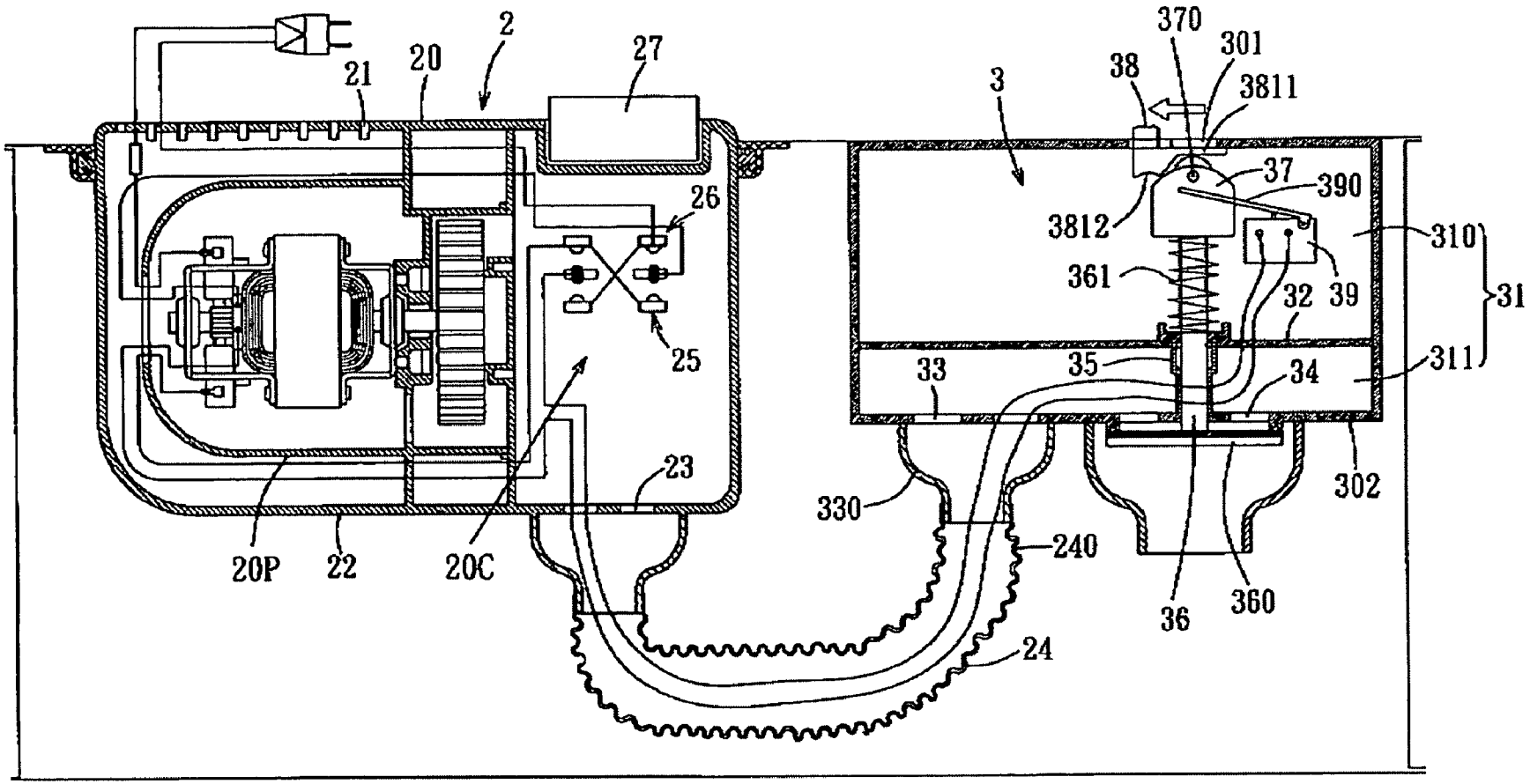
FIG. 1 is a schematic, partly sectional side view of the first preferred embodiment of an electrical air pump assembly according to this invention.

Before the present invention is described in greater detail in connection with the preferred embodiments, it should be noted that similar elements and structures are designated by like reference numerals throughout the entire disclosure.

Figure 26:
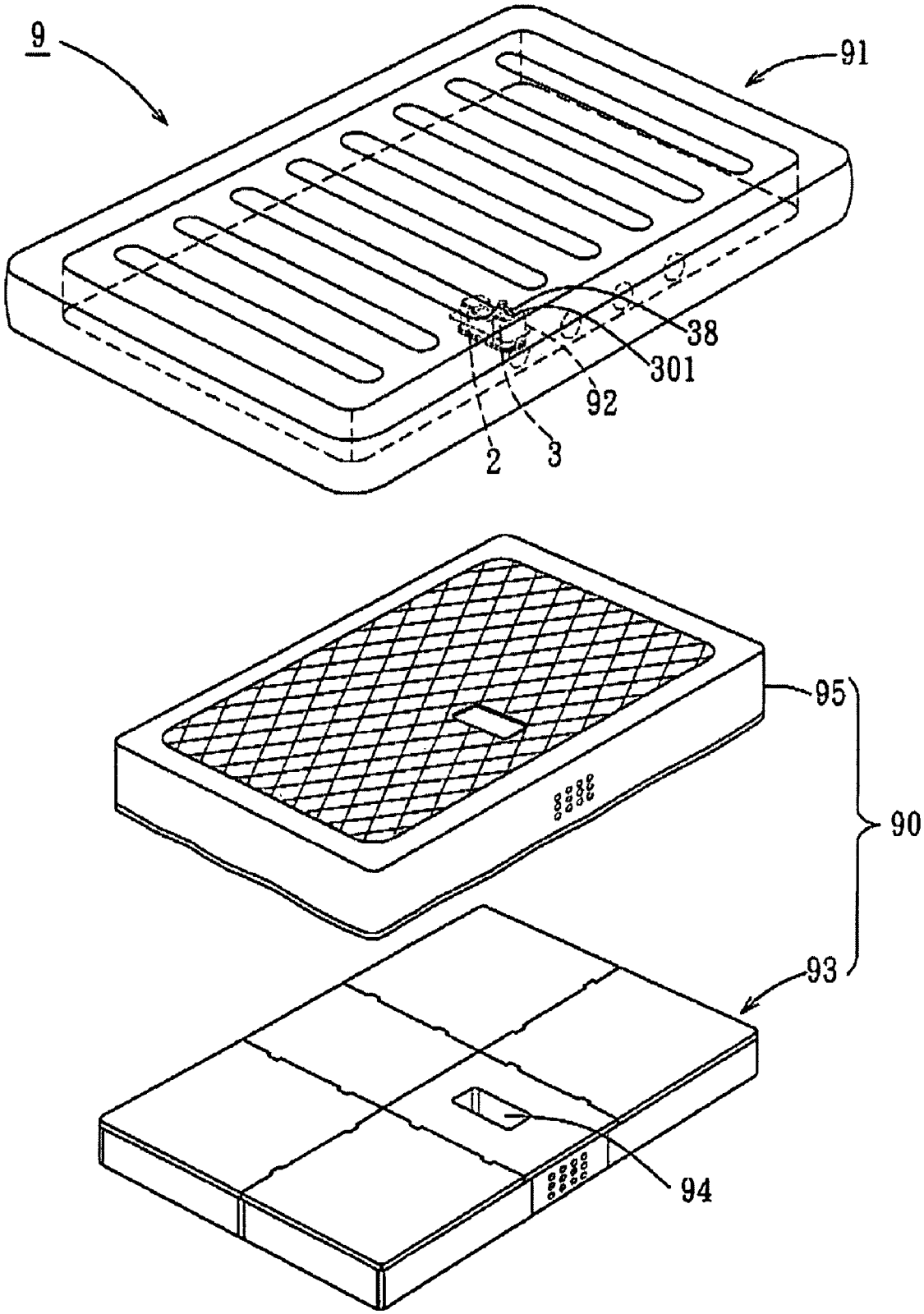
FIG. 26 is a schematic exploded perspective view of an inflatable product, illustrating how the electrical air pump unit of this invention is concealed in the inflatable product.

Referring to FIGS. 1 and 26, the first preferred embodiment of an electrical air pump assembly according to this invention is used to inflate and deflate an air chamber (not shown) defined by an exterior wall of an inflatable body 91 of an inflatable product 9, such as a mattress unit of an inflatable bed. The electrical air pump assembly includes an electrical air pump unit 2 and a controller 3.

The inflatable body 91 has a bottom surface formed with a recess 92. The inflatable product 9 further includes a bedstead 90 consisting of a foldable support frame unit 93 and a cover 95. The bedstead 90 has a top surface formed with a recess 94 cooperating with the recess 92 in the inflatable body 91 to define a space for receiving the electrical air pump unit 2. As such, the electrical air pump unit 2 can be concealed within the inflatable product 9.

The controller 3 is built in the inflatable body 91, has a portion exposed outwardly of the inflatable body 91, and includes an electrical switch 39 connected electrically to the electrical air pump unit 2. The controller 3 is operable manually to activate the electrical air pump unit 2 so as to perform a selected one of inflation, full deflation, and partial deflation of the air chamber in the inflatable body 91 of the inflatable product 9.

The electrical air pump unit 2 has a top surface formed with a plurality of air inlets 21, and a bottom portion formed with an air outlet 23. The controller 3 has a first airport 33 in fluid communication with the air outlet 23 in the electrical air pump unit 2 through an air tube 24, and a second airport 34 in fluid communication with the air camber in the inflatable body 91 of the inflatable product 9. The controller 3 is operable to control opening and closing of the second airport 34 and activation and deactivation of the electrical switch 39 so as to inflate and deflate the air chamber in the inflatable body 91 of the inflatable product 9.

The electrical air pump unit 2 includes a bidirectional pump (20P), a control circuit (20C) connected electrically to the electrical switch 39 and having two contacts 25, 26 for controlling rotation of the bidirectional pump (20P) in two opposite directions, respectively, and a power switch 27 for controlling power supply to the bidirectional pump (20P).

Figure 2:
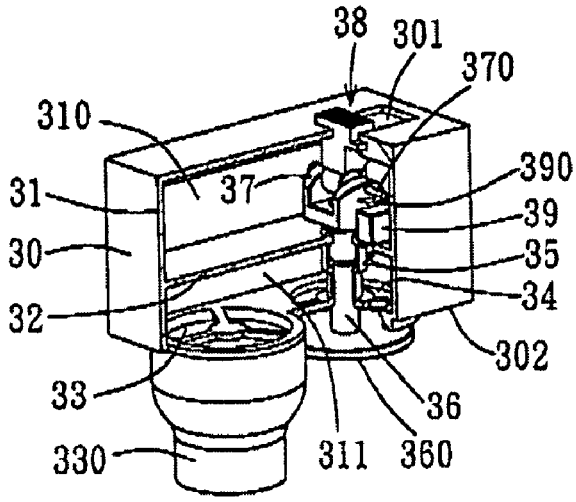
FIG. 2 is a partly sectional perspective view of a controller of the first preferred embodiment.
Figure 3:
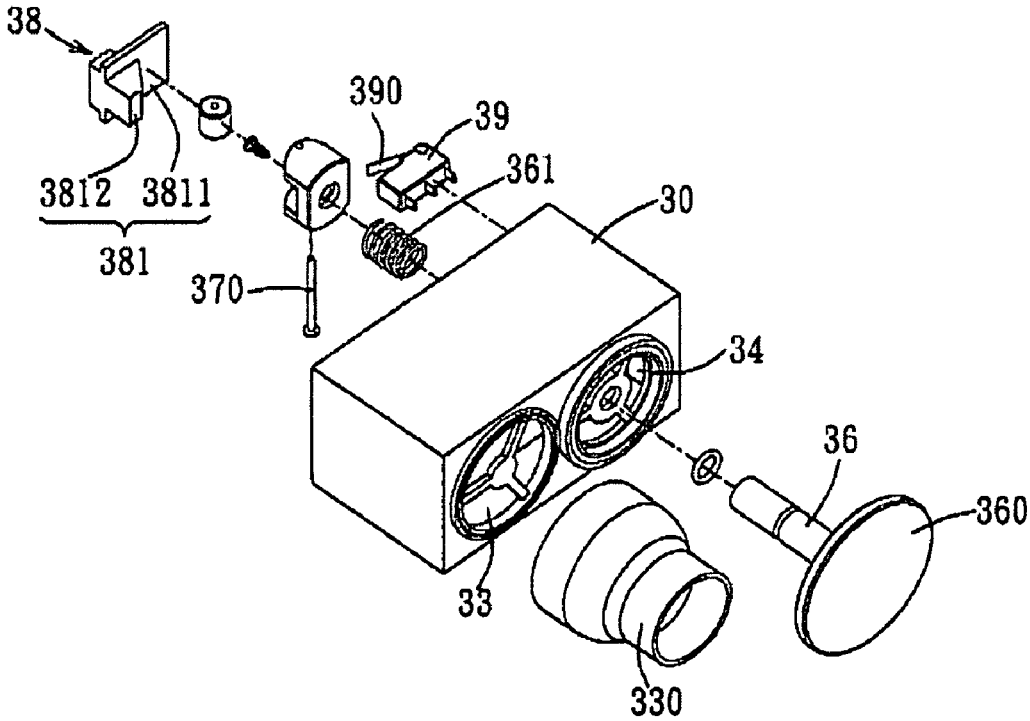
FIG. 3 is an exploded perspective view of the controller of the first preferred embodiment.

With further reference to FIGS. 2 and 3, the controller 3 includes a housing 30, a horizontal partition 32, a valve seat 35, an upright valve rod 36, a valve 360, a follower block 37, a return sprig 361, a fitting 330, a push block 38, a contact rod 390, and a horizontal push rod 370.

The housing 30 defines an accommodating space 31, and has a top surface formed with a slot 301 therethrough, and a bottom surface 302 formed with the first and second airports 33, 34. The second airport 34 is aligned with the slot 301. The partition 32 is disposed fixedly in the housing 39 to divide the accommodating space 31 into an upper accommodating space 310 in fluid communication with the slot 301, and a lower accommodating chamber 311 in fluid communication with the first and second airports 33, 34.

The valve seat 35 is disposed on the partition 32, and is aligned with the second airport 34. The valve rod 36 extends movably through the valve seat 35 and the second airport 34, and is movable relative to the valve seat 35 between an upper limit position shown in FIG. 1 and a lower limit position shown in FIGS. 4 and 5. The valve 360 is connected fixedly to a lower end of the valve rod 36. When the valve rod 36 is disposed in the upper limit position, the second airport 34 is closed by the valve 360. When the valve rod 36 is disposed in the lower limit position, the second airport 34 is open.

The follower block 37 is disposed fixedly on an upper end of the valve rod 36, and is disposed in the upper accommodating chamber 310. The return spring 361 is configured as a coiled compression spring sleeved on the valve rod 36 and disposed between the follower block 37 and the partition 32 for biasing the valve rod 36 to move upwardly in the housing 30.

The fitting 330 is disposed on the bottom surface 302, is in fluid communication with the first airport 33, and is connected fixedly to the end 240 of the air tube 24.

The push block 38 is disposed movably along the slot 301 of the housing 30, and has a bottom cam face 381. The cam face 381 has a first face portion 3811 and a second face portion 3812 disposed below the first face portion 3811, and extends gradually and downwardly from the first face portion 3811 to the second face portion 3812. The follower block 37 is biased by the return spring 361 to contact the cam face 381 of the push block 38. The push block 38 is operably manually to move along the slot 301 to allow a selected one of the first and second face portions 3811, 3812 to contact the follower block 37. When the first face portion 3811 is in contact with the follower block 37, the valve rod 36 is disposed in the upper limit position. When the second face portion 3812 is in contact with the follower block 37, the valve rod 36 is disposed in the lower limit position.

The electrical switch 39 is configured as a microswitch. The contact rod 390 is disposed on the electrical switch 39. The push rod 370 is attached fixedly to the follower block 37, and is perpendicular to the valve rod 36. When the valve rod 36 is disposed in the upper limit position, the push rod 370 is spaced apart from and disposed above the contact rod 390. When the valve rod 36 is disposed in the lower limit position, the push rod 370 contacts the contact rod 390 to thereby activate the bidirectional pump (20P).

With particular reference to FIG. 1, when the valve rod 36 is disposed in the upper limit position, since the second airport 34 is closed, airflow between the electrical air pump unit 2 and the air chamber in the inflatable body 91 of the inflatable product 9 is prevented.

Figure 4:
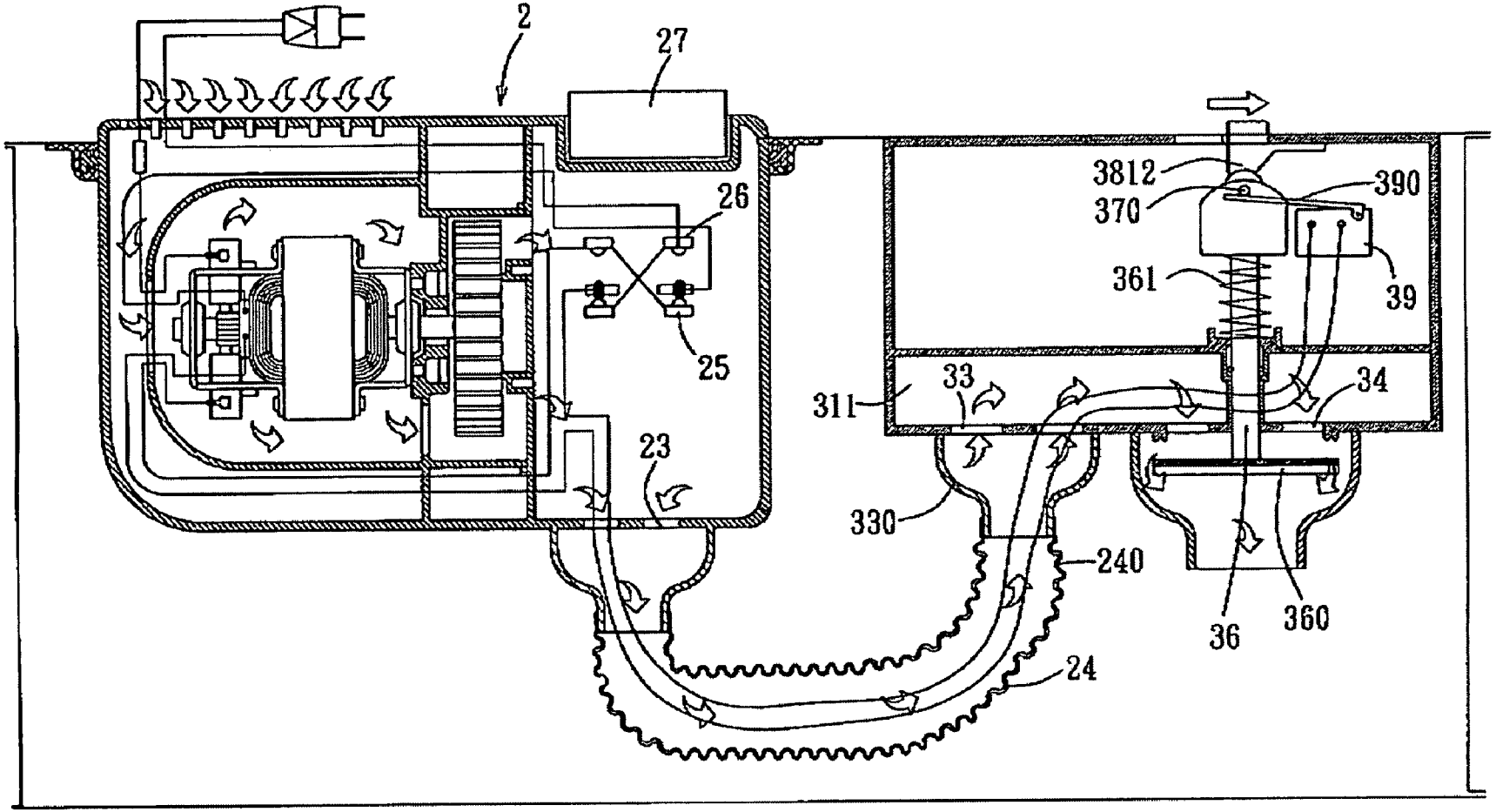
FIG. 4 is a schematic, partly sectional side view of the first preferred embodiment, illustrating an inflation operation.
Figure 5:
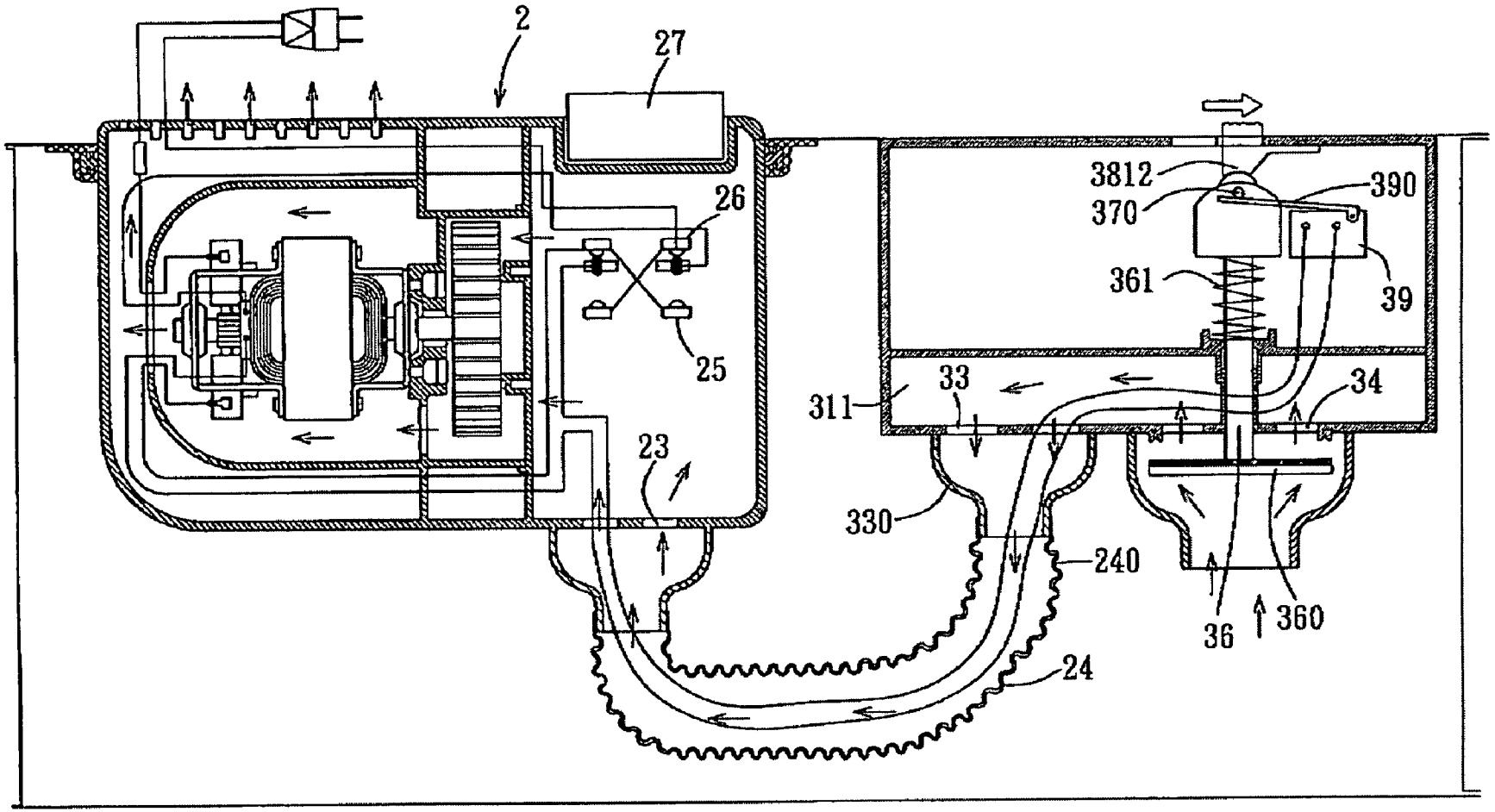
FIG. 5 is a schematic, partly sectional side view of the first preferred embodiment, illustrating a deflation operation.

With particular reference to FIG. 4, when the valve rod 36 is disposed in the lower limit position, since the second airport 34 is open, airflow between the electrical air pump unit 2 and the air chamber in the inflatable body 91 of the inflatable product 9 is allowed. In this state, when the power switch 27 and a changeover switch (not shown) for controlling the rotational direction of the bidirectional pump (20P) are operated to rotate the bidirectional pump (20P) in a direction, an inflation operation is performed by forcing air to flow from the electrical air pump unit 2 into the air chamber in the inflatable body 91 of the inflatable product 9 via an inflation path defined by the air outlet 23, the air tube 24, the fitting 330, the first airport 33, the lower accommodating chamber 311, and the second airport 34. Also in this state, with particular reference to FIG. 5, when the changeover switch is operated to rotate the bidirectional pump (20P) in an opposite direction, a deflation operation is performed by forcing air to flow from the air chamber in the inflatable body 91 of the inflatable product 9 into the electrical air pump unit 2 via a deflation path defined by the second airport 34, the lower accommodating chamber 311, the first airport 33, the fitting 330, the air tube 24, and the air outlet 23.

Figure 6:
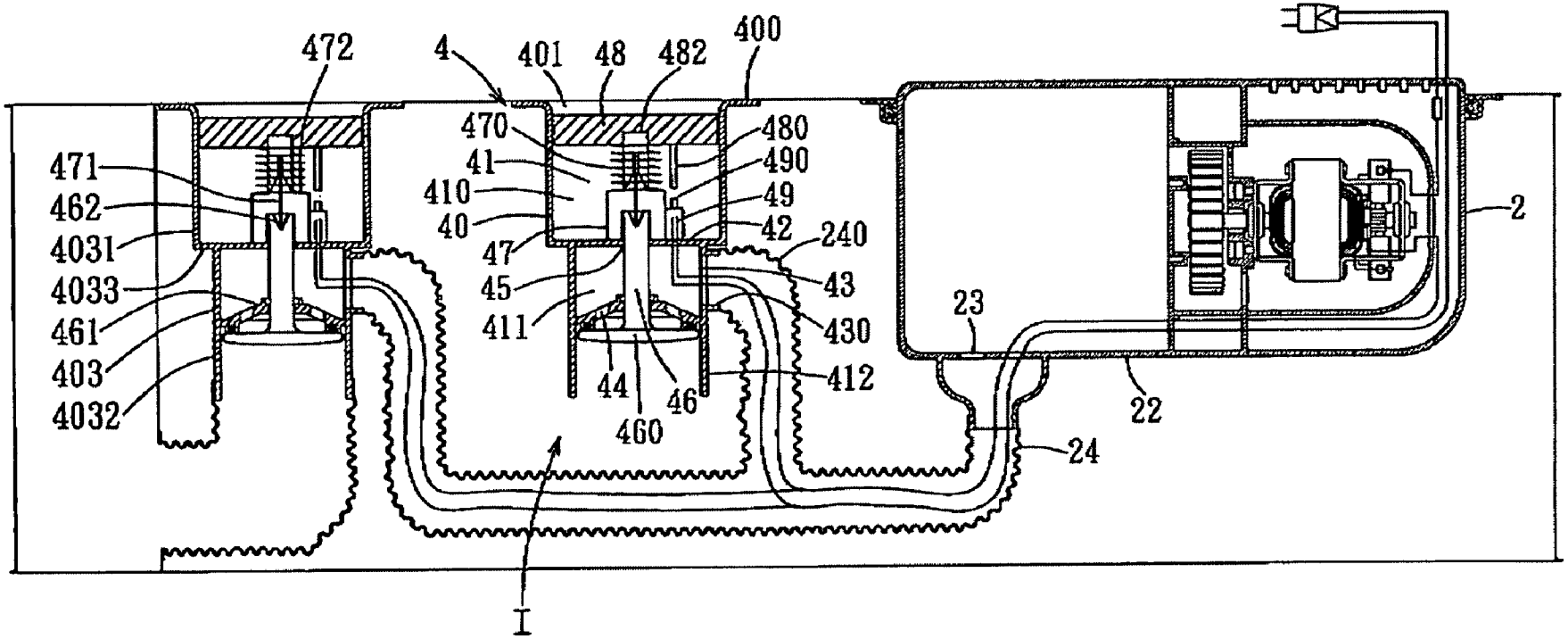
FIG. 6 is a schematic, partly sectional side view of the second preferred embodiment of an electrical air pump assembly according to this invention.

FIG. 6 shows the second preferred embodiment of an electrical air pump assembly according to this invention. In this embodiment, the electrical air pump assembly includes an electrical air pump unit 2 that is similar in construction to the first preferred embodiment, and two controllers 4 each having a first airport 43 in fluid communication with an air chamber (I) defined by an exterior wall of the inflatable body 91 of the inflatable product 9. An air tube 24 is in fluid communication with the first airports 43 in the controllers 4 and the air outlet 23 of the electrical air pump unit 2. Each of the controllers 4 includes a housing 40, a fitting 430, an upright valve rod 46, a valve 460, a cap 47, a lock pin 471, a horizontal push plate 48, a contact rod 490, a push rod 480, and a return spring 470. Since the structures of the controllers 4 are the same, only one will be described hereinafter.

The housing 40 defines an accommodating space 41, and has a top surface 400, and a surrounding wall unit 403, a valve seat 461, and a horizontal partition 42. The top surface 400 is formed with an opening 401. The surrounding wall unit 403 has a large-diameter upper portion 4031, a small-diameter lower portion 4032 formed with a first airport 43, and a shoulder 4033 interconnecting the upper and lower portions 4031, 4032. The valve seat 461 is connected integrally to and disposed within the small-diameter lower portion 4032 of the surrounding wall unit 403, and is formed with a second airport 44. The partition 42 is disposed fixedly in the housing 40 between the upper and lower portions 4031, 4032 of the surrounding wall unit 403 to divide the accommodating space 41 into an upper accommodating chamber 410 in fluid communication with the opening 401, and a lower accommodating chamber 411 in fluid communication with the first and second airports 43, 44.

Figure 8:
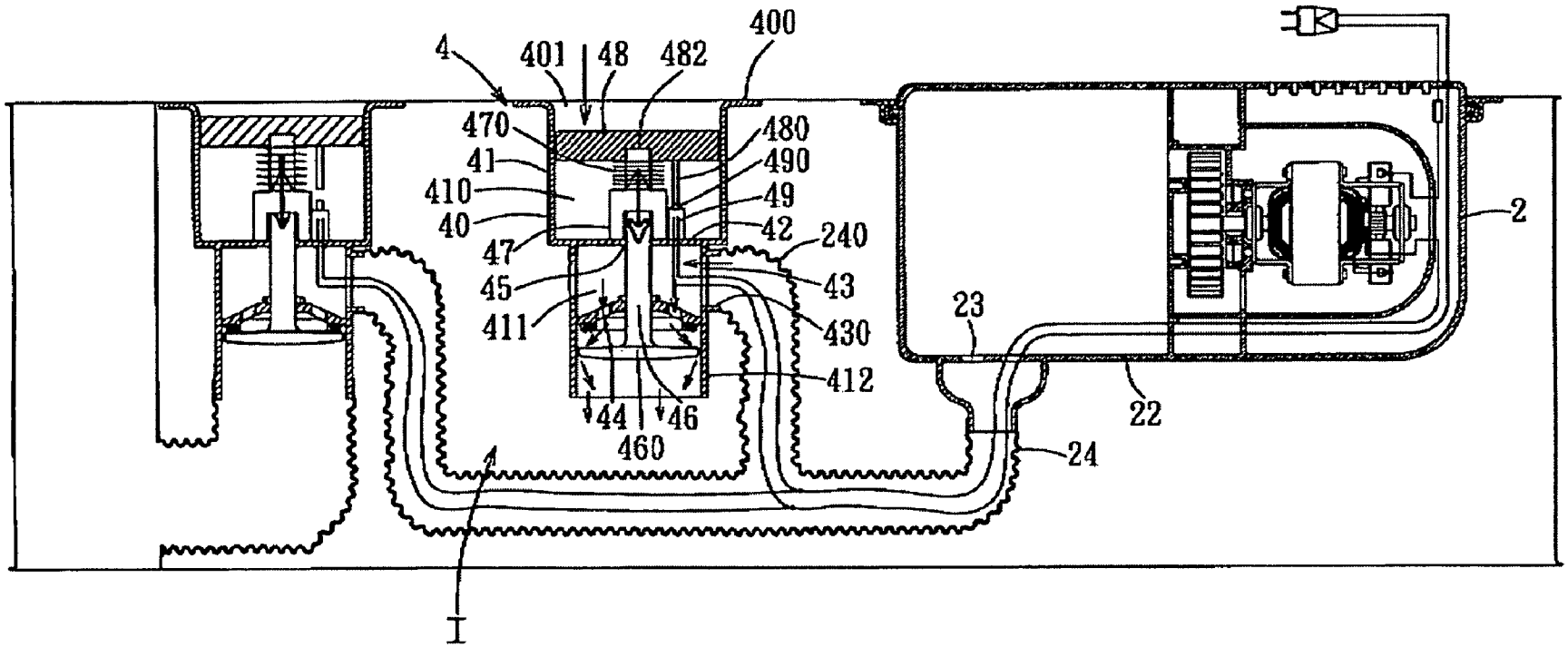
FIG. 8 is a schematic, partly sectional side view of the second preferred embodiment, illustrating an inflation operation.

The fitting 430 is disposed on the lower portion 4032 of the surrounding wall unit 403, is in fluid communication with the first airport 43, and is connected fixedly to the end 240 of the air tube 24. The valve rod 46 extends movably through the partition 42 and the second airport 44, has an upper end formed with a cam groove 462, and is movable relative to the valve seat 461. The valve rod 46 can be held in an upper rod position shown in FIG. 6 and a lower rod position shown in FIG. 8. The valve 460 is connected fixedly to a lower end of the valve rod 46. When the valve rod 46 is disposed in the upper rod position, the second airport 44 is closed by the valve 460. When the valve rod 46 is disposed in the lower rod position, the second airport 44 is open.

The cap 47 is disposed around an upper end of the valve rod 46, and has a shoulder 472. The lock pin 471 is attached to the cap 47, and engages the cam groove 462 in the upper end of the valve rod 46. The push plate 48 has a bottom surface formed with a recess 482 engaging fittingly an upper end of the valve rod 46, and is movable vertically in the housing 40. The push plate 48 can be held in an upper plate position shown in FIG. 6 and a lower plate position shown in FIG. 8. The contact rod 490 is disposed on the electrical switch 49. The push rod 480 extends integrally and downwardly from the push plate 48 toward the contact rod 490, and is parallel to the valve rod 46. The return spring 470 is configured as a coiled compression spring, is sleeved on the cap 47, and is disposed between the shoulder 472 of the cap 47 and the push plate 48.

When the push plate 48 is disposed in the upper plate position, the push rod 480 is spaced apart from the contact rod 490, and the valve rod 46 is held in an upper rod position so that the second airport 44 is closed by the valve 460. When the push plate 48 is disposed in the lower plate position, the push rod 480 is in contact with the contact rod 490 to thereby activate the electrical air pump unit 2, and the valve rod 46 is held in a lower rod position so that the second airport 44 is open. The return spring 470 cooperates with the lock pin 471 and the cam groove 462 in the valve rod 46 to constitute a connecting device for interconnecting the push plate 48 and the valve rod 46 to hold the valve rod 46 in the upper and lower rod positions. The push plate 48 can be depressed to move from one of the upper and lower plate positions to the other of the upper and lower plate positions. Movement of the push plate 48 from the upper plate position to the lower plate position results in movement of the valve rod 46 from the upper rod position to the lower rod position. Movement of the push plate 48 from the lower plate position to the upper plate position results in movement of the valve rod 46 from the lower rod position to the upper rod position. The structure and operation of such connecting device are similar to those disclosed in U.S. Pat. Nos. 5,068,506 and 6,759,615.

Figure 7:
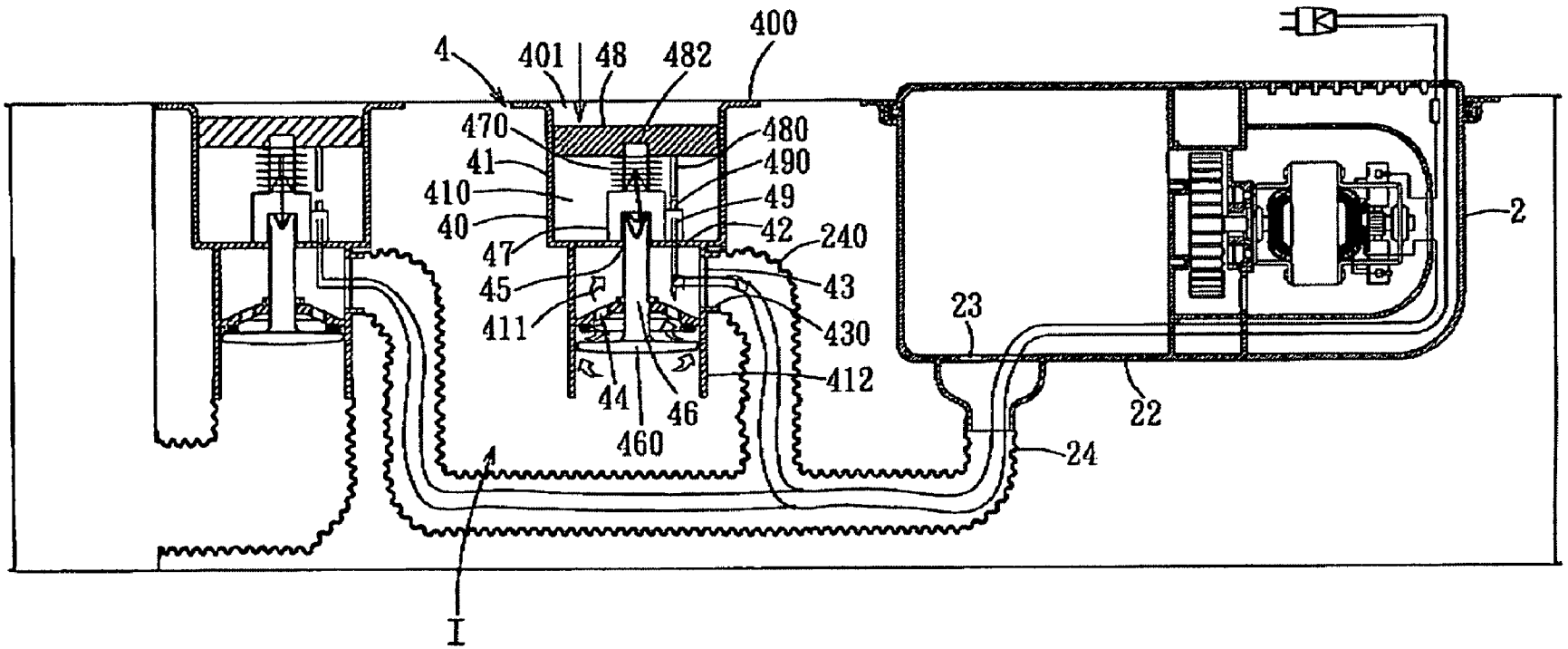
FIG. 7 is a schematic, partly sectional side view of the second preferred embodiment, illustrating a deflation path.

In this embodiment, the electrical air pump unit 2 includes a unidirectional pump. When the push rod 480 comes into contact with the contact rod 490, the electrical air pump unit 2 is activated by the electrical switch 49 to inflate the air chamber (I) in the inflatable body 91 of the inflatable product 9. When the push plate 48 is in any position other than the upper plate position, such as that shown in FIG. 7, the second airport 44 is open to allow flow of air from the air chamber (I) in the inflatable body 91 of the inflatable product 9 into the electrical air pump unit 2 through the controller 4 and the air tube 24. Hence, the air chamber (I) in the inflatable body 91 of the inflatable product 9 is deflated partially through unaided exhaust of air through a valve opening (not shown).

Figures 9, 9A:
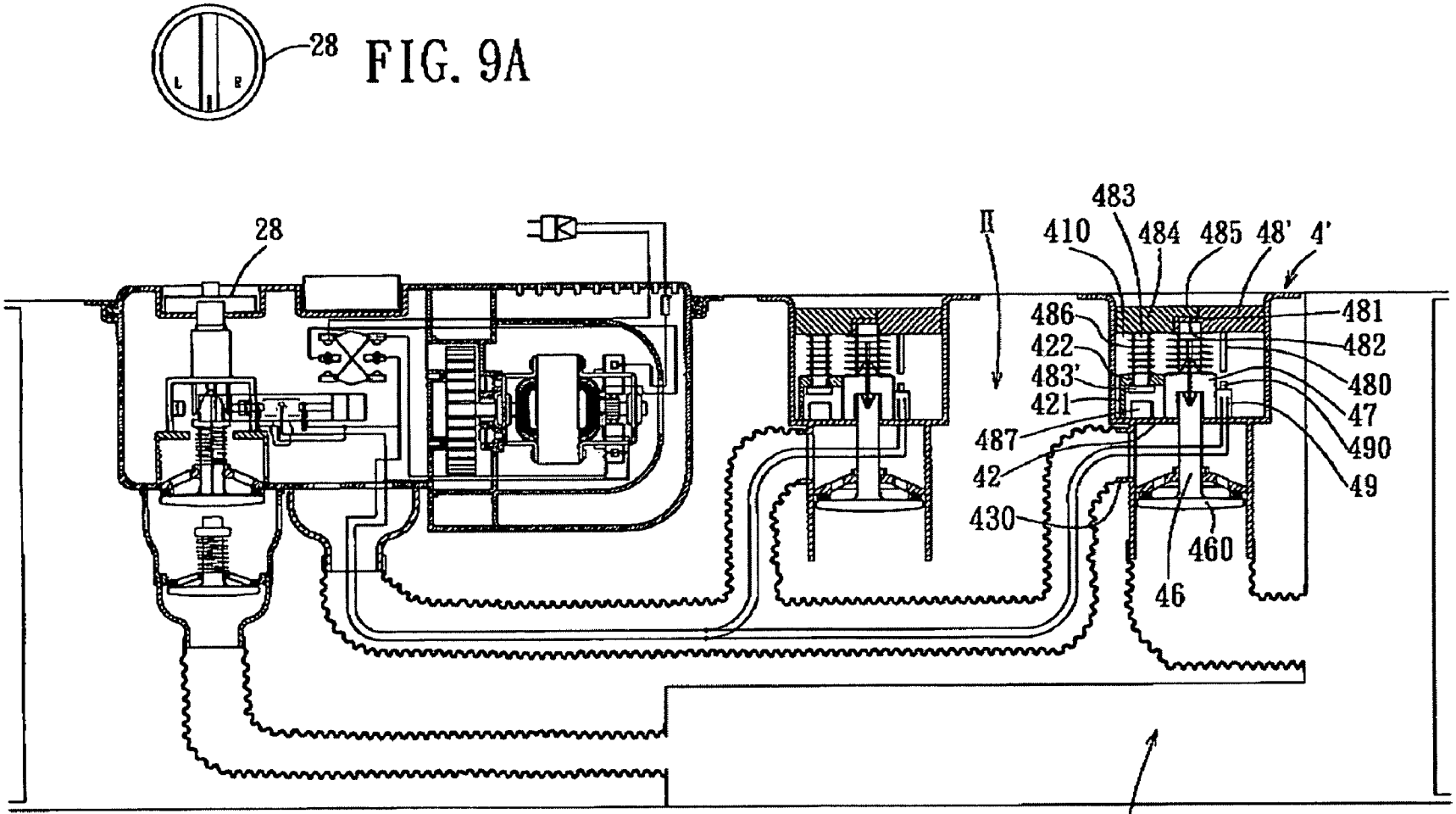
FIG. 9 is a schematic, partly sectional side view of the third preferred embodiment of an electrical air pump assembly according to this invention.
FIG. 9A is a top view of a changeover switch of the third preferred embodiment.
Figure 10:
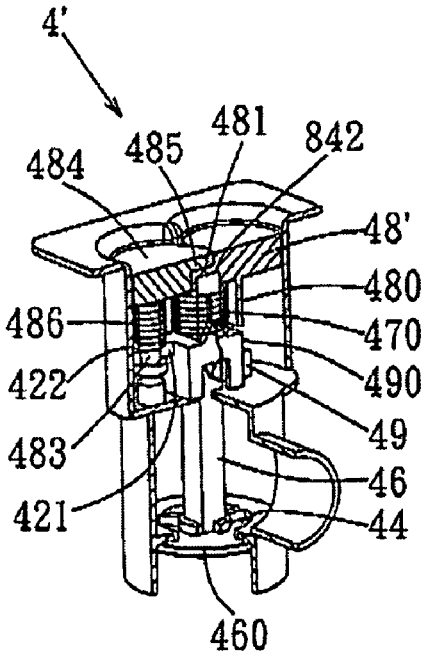
FIG. 10 is a partly sectional perspective view of a controller of the third preferred embodiment.
Figure 11:
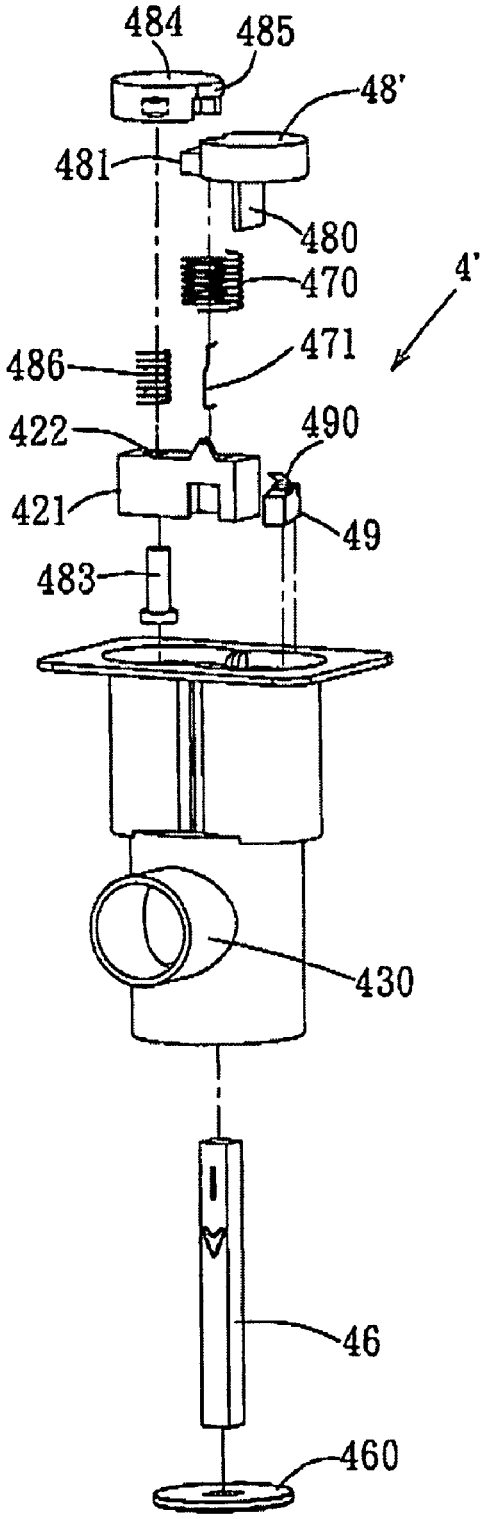
FIG. 11 is an exploded perspective view of the controller of the third preferred embodiment.

FIGS. 9, 10, and 11 show the third preferred embodiment of an electrical air pump assembly according to this invention, which is similar in construction to the second preferred embodiment. In this embodiment, the push plate 48' is formed with an integral engaging projection 481, and the controller 4' further includes a mounting member 421, an upright movable rod 483, an auxiliary plate 484, a resilient member 486, and a stop member 487. The mounting member 421 is disposed fixedly on and above the partition 42 and in the upper accommodating chamber 410, and is formed with a hole 422 therethrough. The movable rod 483 extends movably through the hole 422 in the mounting member 421, and is formed with an outward flange 483' extending and outwardly from a lower end thereof. The auxiliary plate 484 is connected fixedly to an upper end of the movable rod 483, and is formed with an integral pressing projection 485 abutting against and disposed above the engaging projection 481 of the push plate 48' so as to allow for synchronous movement of the push plate 48' and the auxiliary plate 484 when the auxiliary plate 484 is depressed. Thus, to deflate the air chamber in the inflatable body 91 of the inflatable product 9, either the push plate 48' or the auxiliary plate 484 can be operated to move the valve rod 46 downwardly to thereby open the second airport 44.

Figure 13:
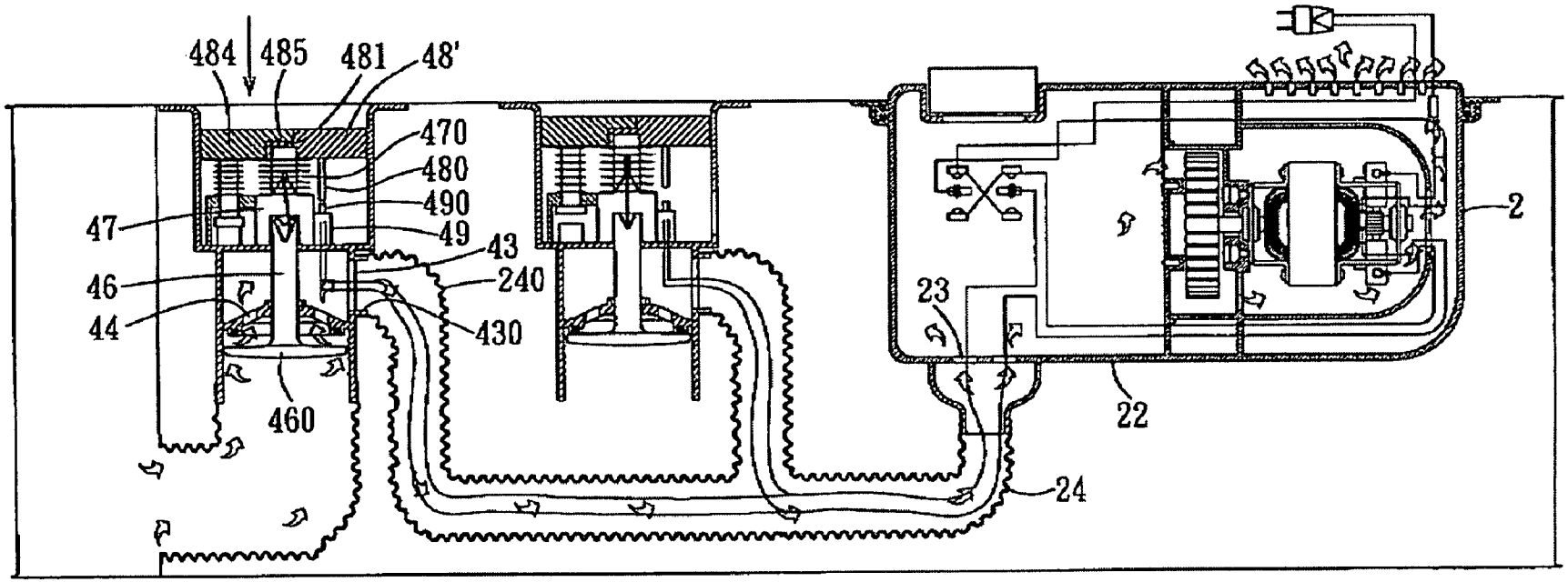
FIG. 13 is a schematic, partly sectional side view of the third preferred embodiment, illustrating how a deflation operation is performed by only opening a second airport.

The resilient member 486 is configured as a coiled compression spring, is sleeved on the movable rod 483, and is disposed between the mounting member 421 and the auxiliary plate 484 for biasing the outward flange 483' of the movable rod 483 to abut against the mounting member 421. The stop member 487 is fixed on and above the partition 42 and under the outward flange 483', and is spaced apart from the outward flange 483' by a predetermined distance. When the outward flange 483' is moved downwardly to contact the stop member 487, the push rod 480 is spaced apart from the contact rod 490, as shown in FIG. 13. As such, depression of the auxiliary plate 484 cannot result in activation of the electrical switch 49 and the electrical air pump unit 2. In other words, the electrical switch 49 can be activated through operation of only the push plate 48'.

Figure 24:
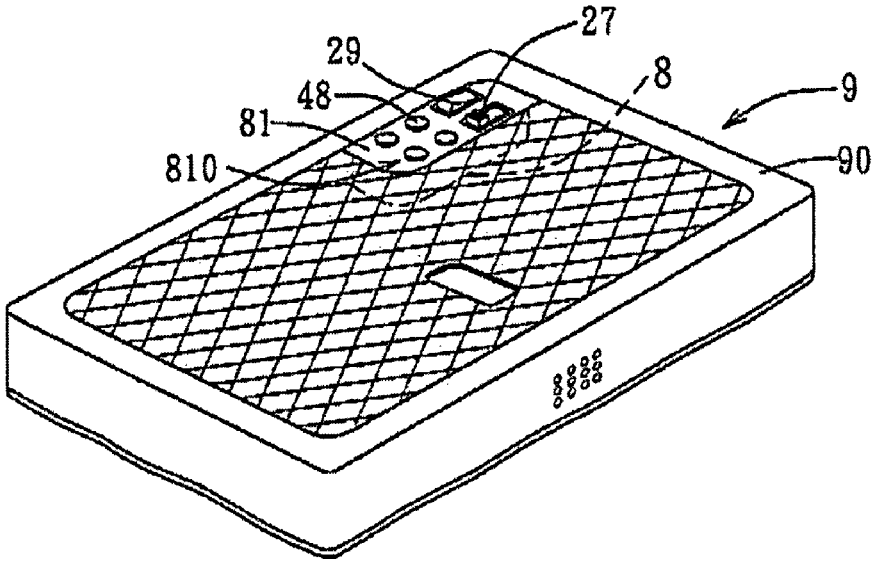
FIG. 24 is a perspective view of a control case assembly of the electrical air pump unit of this invention, in a state being mounted to a bedstead.
Figure 25:
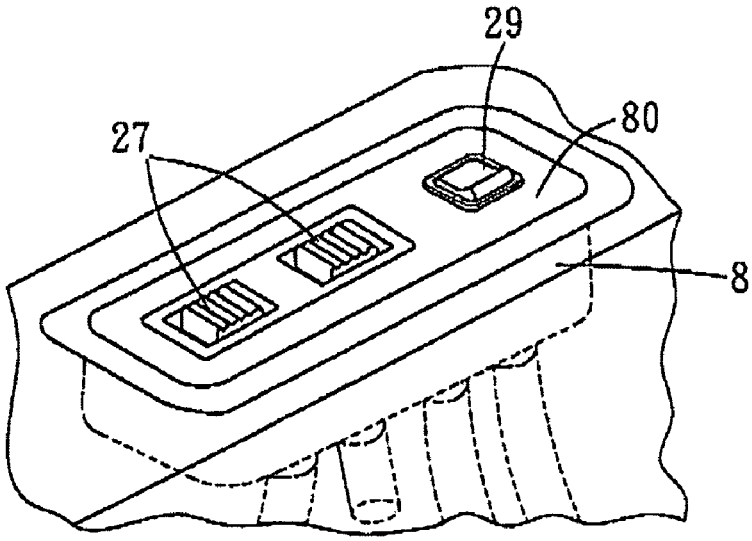
FIG. 25 is a perspective view of a modified control case assembly of the electrical air pump unit of this invention.

With further reference to FIG. 9A, in this embodiment, the changeover switch 28 is configured as a rotary knob. Alternatively, with reference to FIG. 24, the changeover switch is configured as a push type switch 29, and the push type switch 29 and the power switch 27 are disposed on a control panel 80 of a control case 8. The control case 8 is disposed in the bedstead 90 of the inflatable product 9. Four push plates 48 are also disposed on the control panel 80. The control case 8 cooperates the push plates 48, the power switch 27, and the changeover switch 29 to constitute a control case assembly. FIG. 25 shows a modified control case assembly that includes two power switches 27 and a changeover 29.

FIGS. 14, 15, 16, and 17 show the fourth preferred embodiment of an electrical air pump assembly according to this invention, which includes an electrical air pump unit 2 similar in construction to the first preferred embodiment, and a push-type controller 5. The push-type controller 5 includes a housing 50, a horizontal partition 52, a tubular mounting seat 55, a hollow driving member 56, an inclined push plate 570, a return spring 563, a fitting 530, an upright valve rod 58, a valve 580, a contact rod 590, and a push rod 561.

The housing 50 defines an accommodating space 51, and has a top surface 500 formed with an opening 502, and a bottom surface 501 formed with first and second airports 53, 54. The second airport 54 is aligned with the opening 502. The partition 52 is disposed fixedly in the housing 50 to divide the accommodating space 51 into an upper accommodating chamber 510 in fluid communication with the opening 502, and a lower accommodating chamber 511 in fluid communication with the first and second airports 53, 54. The mounting seat 55 has an inclined seat portion 550 connected to a wall of the housing 50 defining the opening 502, and a vertical seat portion 551 extending from the inclined seat portion 550 toward the partition 52. The vertical seat portion 551 has a bottom end wall that is formed with a hole 5500 and a downwardly projecting guiding member 5501. The hole 5500 is aligned with the second airport 54. The driving member 56 is disposed movably within the mounting seat 55, and has a shoulder 564, and a bottom end wall formed with a slide slot 562.

Figure 14:
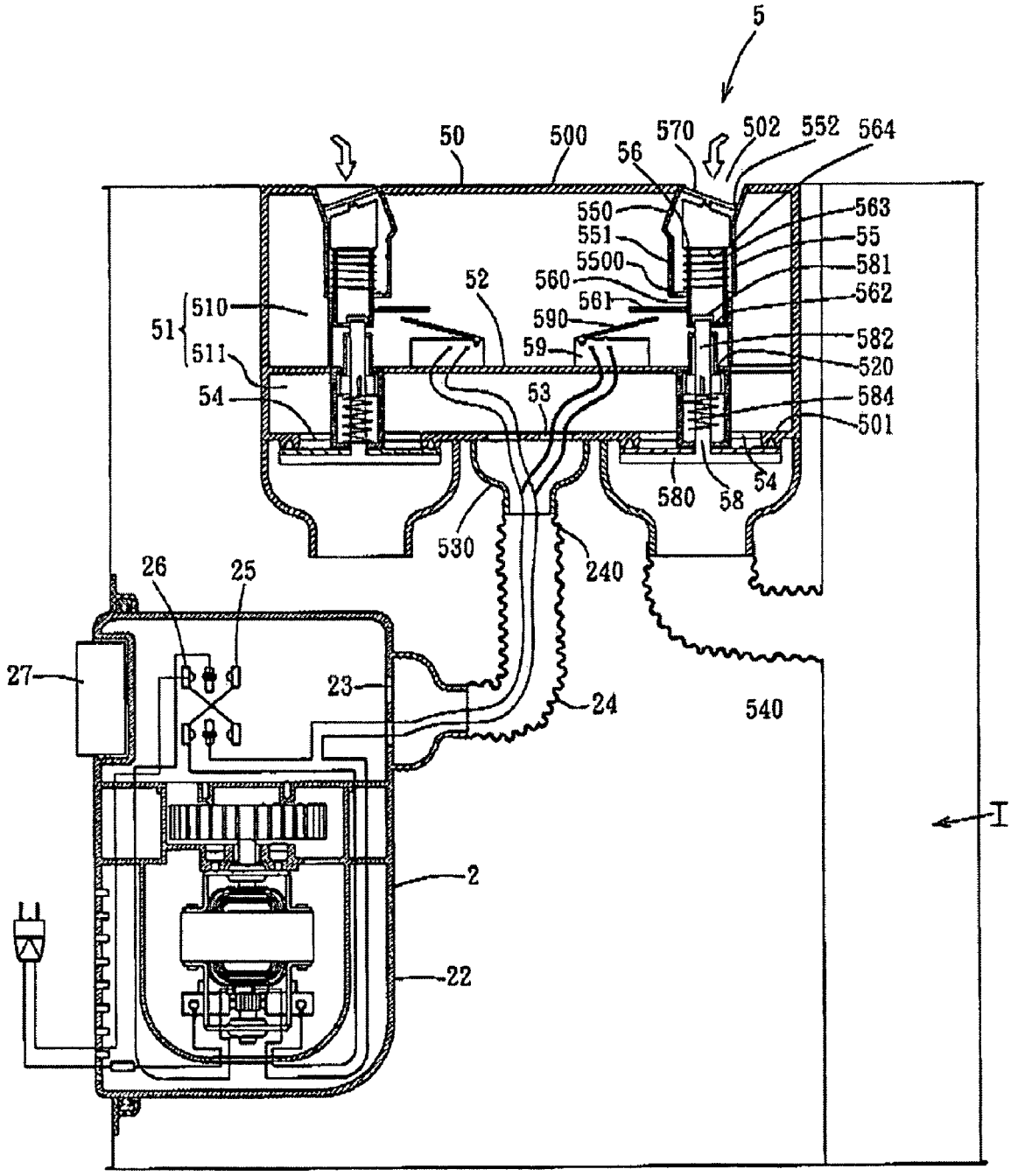
FIG. 14 is a schematic, partly sectional side view of the fourth preferred embodiment of an electrical air pump assembly according to this invention.
Figure 15:
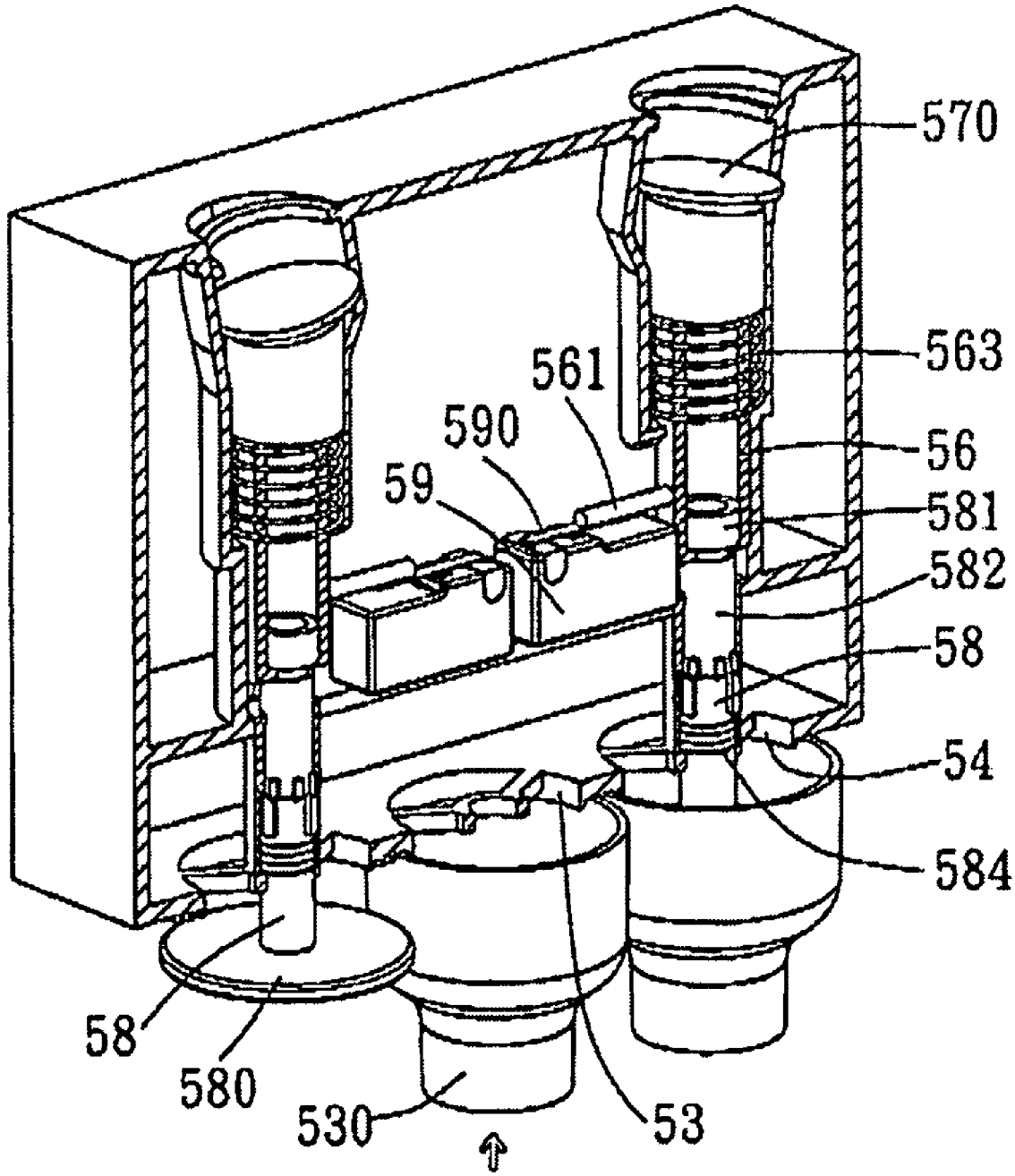
FIG. 15 is a partly sectional perspective view of a controller of the fourth preferred embodiment.
Figure 16:
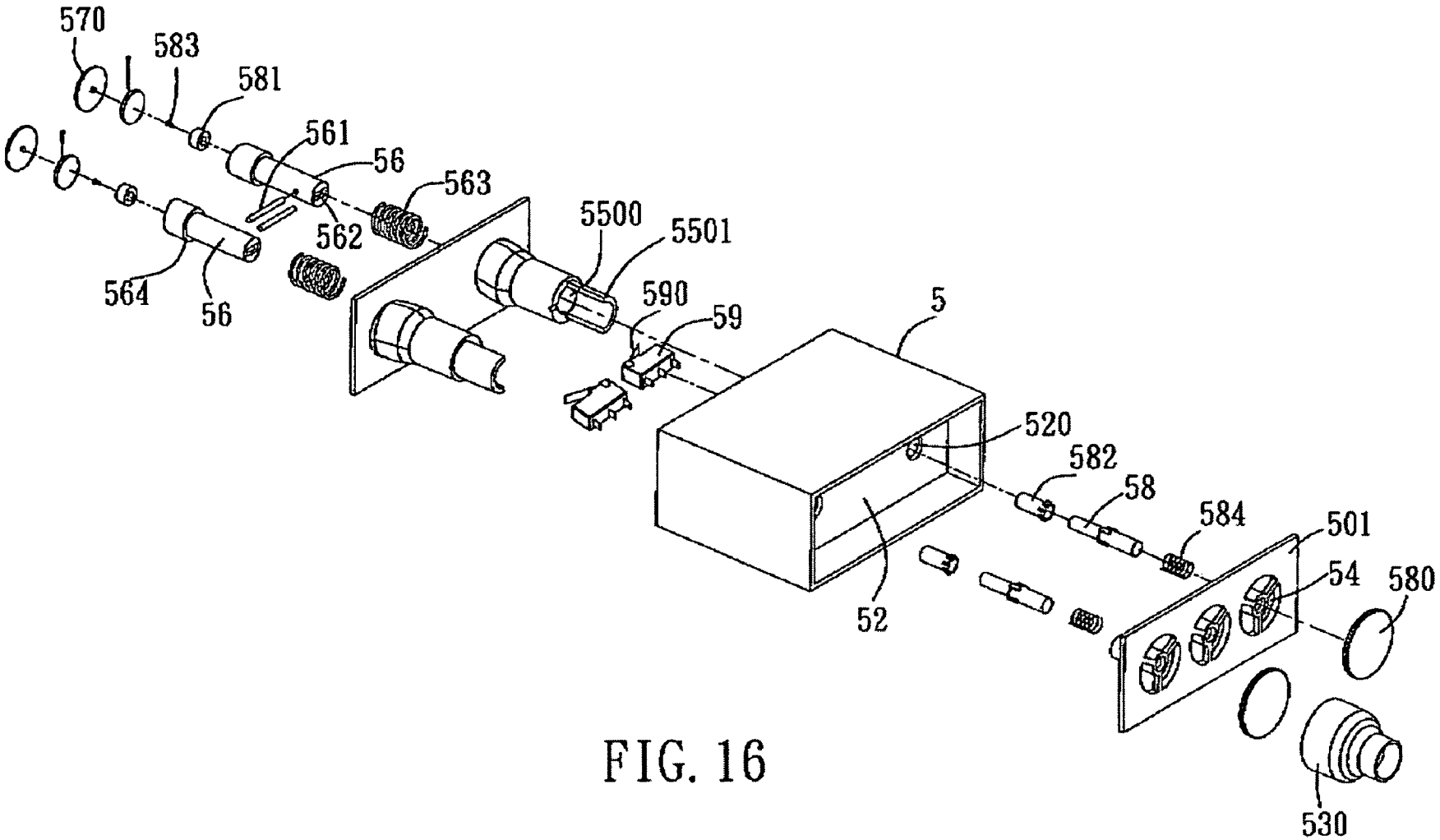
FIG. 16 is an exploded perspective view of the controller of the fourth preferred embodiment.
Figure 17:
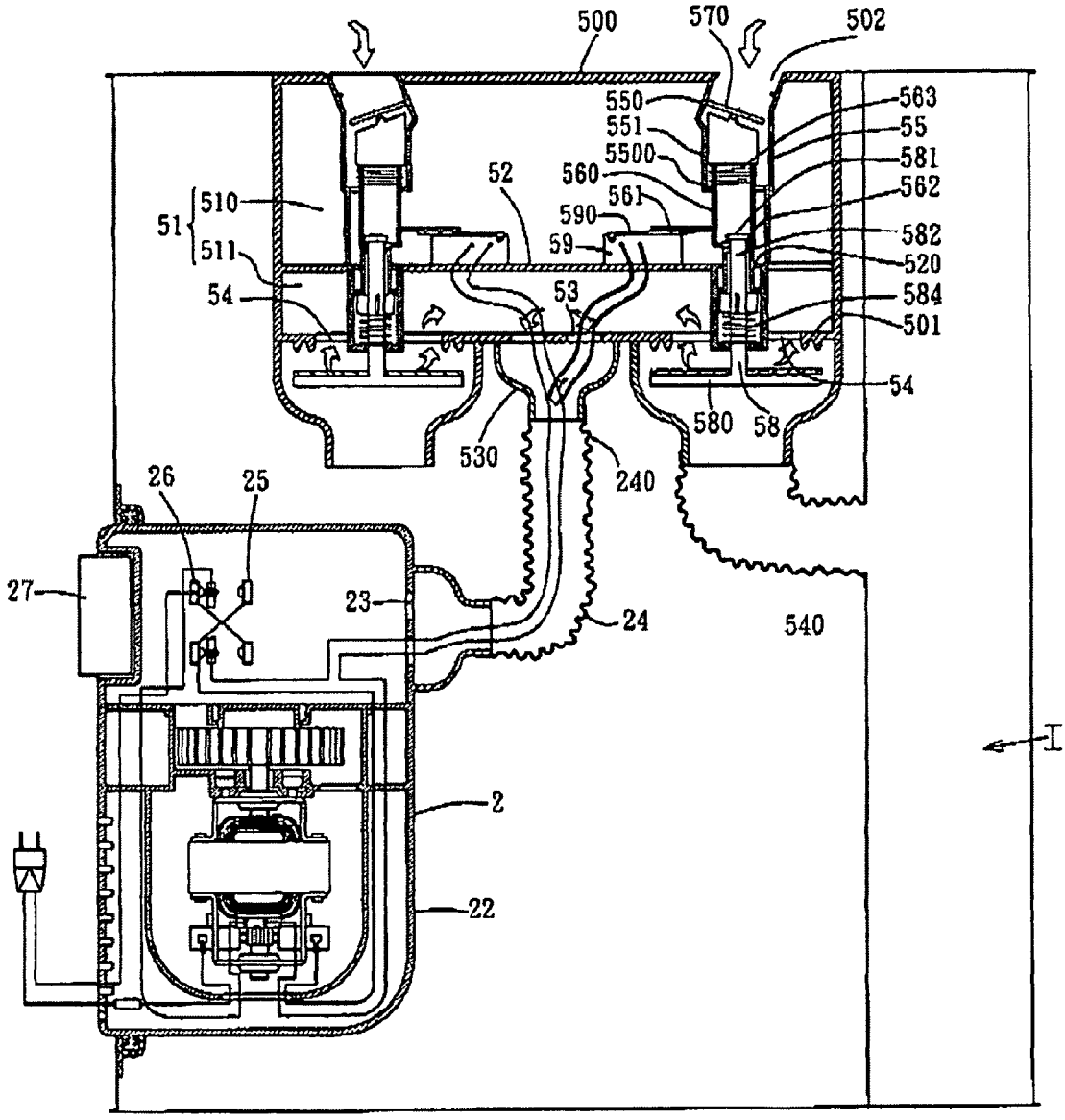
FIG. 17 is a schematic, partly sectional side view of the fourth preferred embodiment, illustrating a deflation operation.

The push plate 570 is received movably within the inclined seat portion 550 of the mounting seat 55, is attached to and disposed above the driving member 56, and is movable within the mounting seat 55 to an upper plate position shown in FIG. 14 and a lower plate position shown in FIG. 17. The push plate 570 is perpendicular to an axial direction of the inclined seat portion 550 of the mounting seat 55. The return spring 563 is configured as a coiled compression spring, is sleeved on the driving member 56, and is disposed between the shoulder 564 of the driving member 56 and the bottom end wall of the vertical seat portion 551 of the mounting seat 55 for biasing the push plate 570 toward the upper plate position. In the upper plate position, the push plate 570 abuts against a stop member 552 of the mounting seat 55 to thereby prevent upward removal of the push plate 570 from the mounting seat 55.

The fitting 530 is disposed on the housing 50, is connected fixedly to the end 240 of the air tube 24, and is in fluid communication with the first airport 53. The valve rod 58 extends movably through the partition 52 and the second airport 54, and is movable relative to the partition 52 to an upper rod position shown in FIG. 14 and a lower rod position shown in FIG. 17. The valve rod 58 is connected to the driving member 56 by a connecting unit. The connecting unit includes a retaining cap 581, a rotatable connecting rod 582, a bolt 583, and a return spring 584. The retaining cap 581 is sleeved on and fastened to an upper end of the connecting rod 582 by the bolt 583. The connecting rod 582 is guided to move vertically relative to the mounting seat 55. The bolt 583 extends movably through the slot 562 in the driving member 56. The return spring 584 is configured as a coiled compression spring, and is sleeved on the valve rod 58. The push plate 570 can be depressed to move from one of the upper and lower plate positions to the other of the upper and lower plate positions. When the push plate 570 is moved in the mounting seat 55, the driving member 56 moves vertically and horizontally within the mounting seat 55. Hence, the bolt 583 moves vertically relative to the mounting seat 55 to thereby allow for rotation of the connecting rod 582 relative to the valve rod 58. Movement of the push plate 570 from the upper plate position to the lower plate position results in movement of the valve rod 58 from the upper rod position to the lower rod position. Movement of the push plate 570 from the lower plate position to the upper plate position results in movement of the valve rod 58 from the lower rod position to the upper rod position. The structure and operation of such connecting unit are similar to those disclosed in U.S. Pat. Nos. 5,275,497 and 6,413,429.

Similar to the third preferred embodiment, the valve 580 is connected fixedly to a lower end of the valve rod 58, and is positioned so that the second airport 54 is closed by the valve 580 when the valve rod 58 is disposed in the upper rod position and so that the second airport 54 is open when the valve rod 58 is disposed in the lower rod position. The contact rod 590 is disposed on the electrical switch 59. The push rod 561 is attached fixedly to and extends laterally from the driving member 56, and is movable to contact the contact rod 590 when the valve rod 58 is disposed in the lower rod position.

Figure 18:
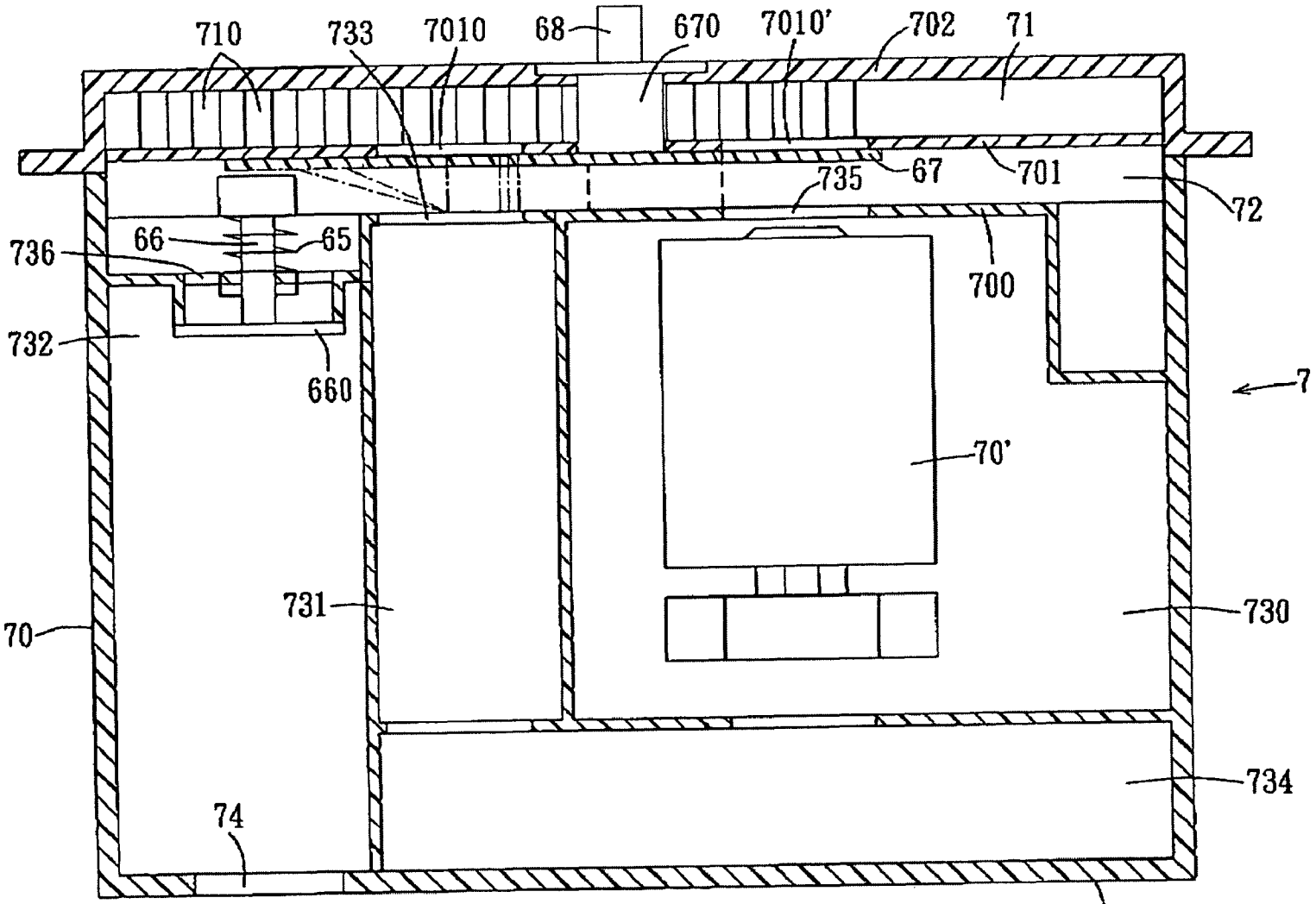
FIG. 18 is a schematic, partly sectional side view of the fifth preferred embodiment of an electrical air pump assembly according to this invention.
Figure 19:
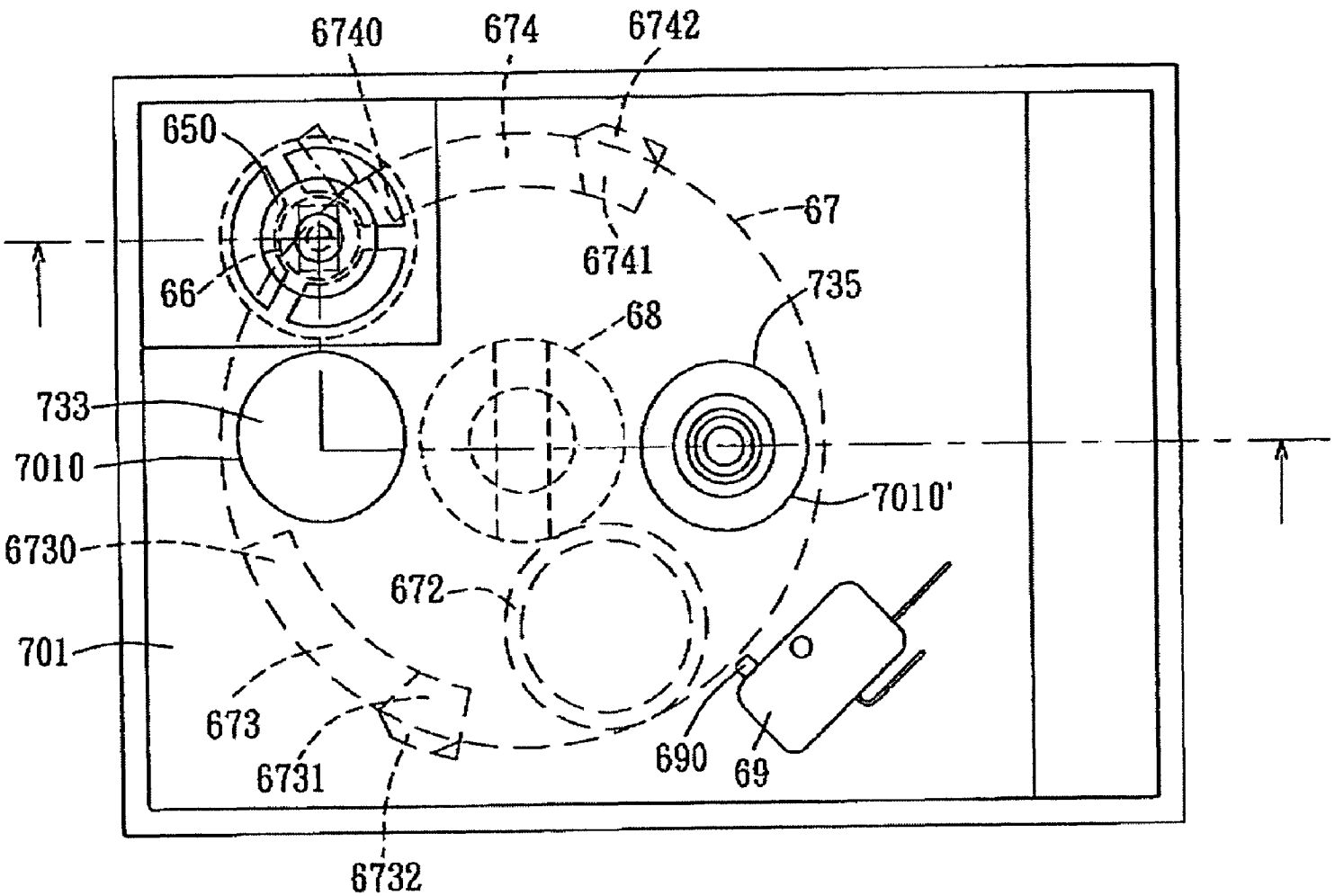
FIG. 19 is a schematic top view of a controller of the fifth preferred embodiment.

FIGS. 18 and 19 show the fifth preferred embodiment of an electrical air pump assembly according to this invention, which includes a controller 6 and an electrical air pump unit 7. The controller 6 and the electrical air pump unit 7 are different from those of the previous preferred embodiments in construction.

The electrical air pump unit 7 includes a housing 70 and a unidirectional air pump 70'. The housing 70 has horizontal upper and lower partitions 701, 700, a first air space 71, a second air space 72, a pump-receiving space 730, a middle space 731, a valve-receiving space 732, a lower space 734, an air inlet 733, an air outlet 735, and an airport 74. The first air space 71 is disposed at an upper end portion of the housing 70, and is in fluid communication with the ambient via a plurality of vent holes 710. The second air space 72 is disposed immediately under the first air space 71. The upper partition 701 is disposed between the first and second air spaces 71, 72, and is formed with a pair of first and second circular holes 7010, 7010' therethrough. The pump-receiving space 730, the valve-receiving space 732, and the middle air space 731 are disposed immediately under and spaced apart from the second air space 72 by the lower partition 700. The middle air space 731 is disposed between the pump-receiving space 730 and the valve-receiving space 732. The lower air space 734 is disposed immediately under and in fluid communication with the pump-receiving space 730 and the middle air space 731. The air inlet 733 is formed through the lower partition 700, and is in fluid communication with the second air space 72 and the middle air space 731. The air outlet 735 is formed through the lower partition 700, and is in fluid communication with the second air space 72 and the pump-receiving space 730. The air inlet 733 and the air outlet 735 are aligned respectively with the first and second circular holes 7010, 7010' in the upper partition 701. A valve hole 736 is in fluid communication with the second air space 72 and the valve-receiving space 732. The airport 74 is in fluid communication with the valve-receiving space 732 and the air chamber in the inflatable body 91 of the inflatable product 9. The air pump 70 is disposed within the pump-receiving space 730.

The controller 6 includes an upright valve rod 66, a valve 660, a rotary disk 67, a conduit 672, and a spring 65. The valve rod 66 extends movably through the valve hole 736 in the housing 70, and is movable in the housing 70 between an upper limit position shown in FIG. 18 and a lower limit position shown in FIGS. 21 and 23. The valve 660 is connected fixedly to a lower end of the valve rod 66. When the valve rod 66 is disposed in the upper limit position, the valve hole 736 is closed by the valve 660. When the valve rod 66 is disposed in the lower limit position, the valve hole 736 is open. The rotary disk 67 includes a cam face unit and a contact unit. A rotary knob 68 is connected integrally to a rotating shaft 670 of the rotary disk 67, and is operable to rotate the rotary disk 67 within the second air space 72. The electrical switch 69 is disposed adjacent to and spaced apart from an outer periphery of the rotary disk 67, and is connected electrically to the air pump 70'.

The conduit 672 is connected integrally and centrifugally to the rotary disk 67, and is rotatable to align with a selected one of the air inlet 733 and the air outlet 735.

Figure 21:
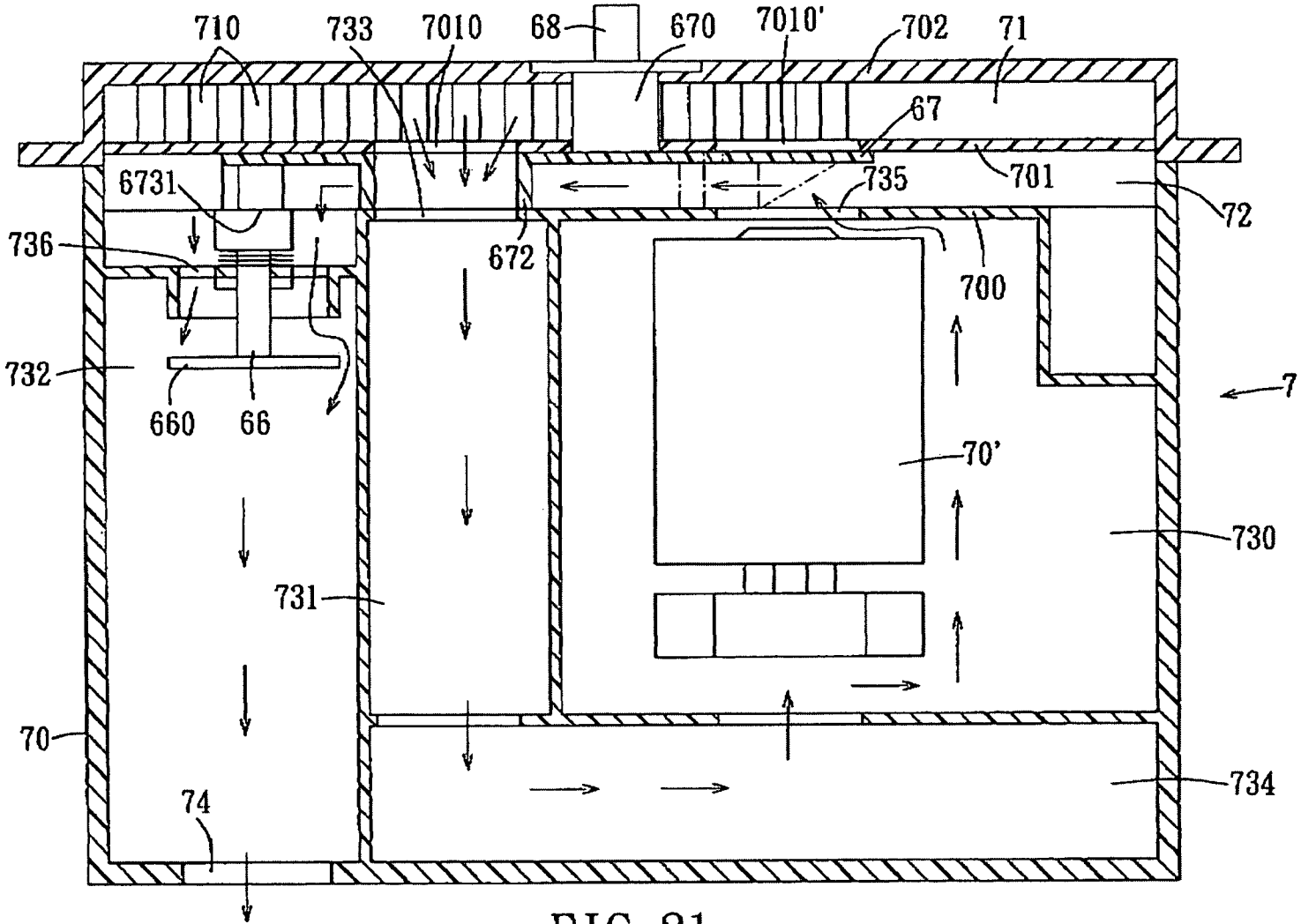
Figure 23:
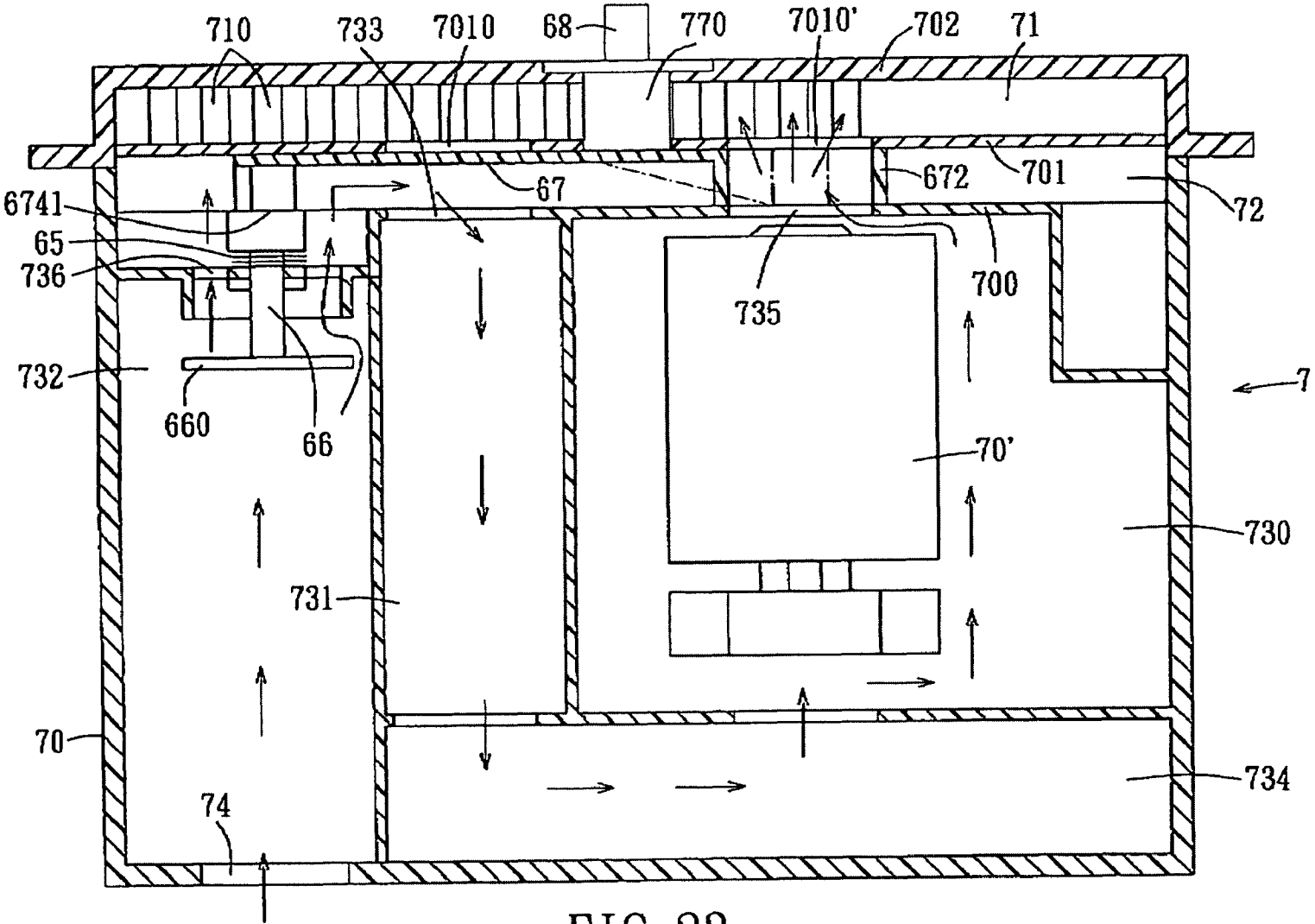

The rotary disk 67 has a flat bottom surface and two downward projections extending downwardly from the flat bottom surface and formed respectively with a pair of elongated and curved first and second cam faces 673, 674 that extend along a circumferential direction of the rotary disk 67. The first and second cam faces 673, 674 constitute the cam face unit. Each of the first and second cam faces 673, 674 has an inner end 6730, 6740 and an outer end 6731, 6741 opposite to the inner end 6730, 6740, and extends gradually and downwardly from the inner end 6730, 6740 to the outer end 6731, 6741. The inner ends 6730, 6740 are located between and above the outer ends 6731, 6741. The spring 65 biases an upper and of the valve rod 66 to contact the cam face unit of the rotary disk 67 when the cam face unit of the rotary disk 67 is aligned with the valve rod 66. When the conduit 672 is aligned with either the air inlet 733 or the air outlet 735, the valve rod 66 is disposed in the lower limit position, as shown in FIGS. 21 and 23. The upper end of the valve rod 66 is movable between and on the first and second cam faces 673, 674.

The controller 6 further includes a contact rod 690 disposed on the electrical switch 69. The contact unit of the rotary disk 67 includes a pair of first and second radial projections 6732, 6742 extending respectively, radially, and outwardly from the downward projections. Each of the radial projections 6732, 6742 is rotatable to contact the contact rod 690.

Figure 20:
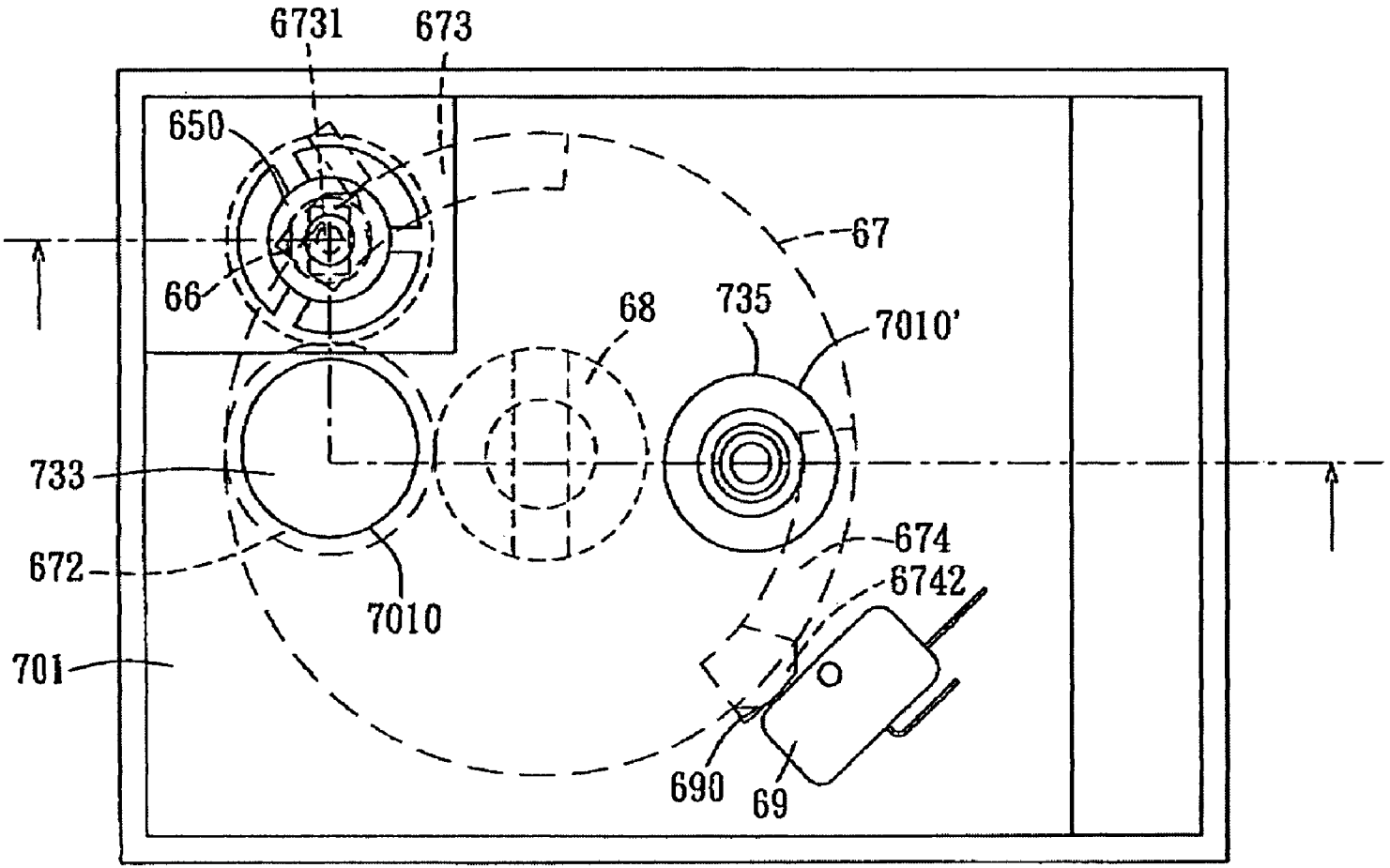
FIGS. 20 and 21 are respectively schematic top view and schematic, partly sectional side view of the controller of the fifth preferred embodiment, illustrating an inflation operation.

With particular reference to FIGS. 20 and 21, when it is desired to inflate the air chamber in the inflatable body 91 of the inflatable product 9, the rotary knob 68 is operated manually so as to rotate the rotary disk 67 in the second air space 72 in the housing 70 to a first angular position, thereby aligning the conduit 672 with the air inlet 733 and the first circular hole 7010 in the housing 70. In the first angular position, the upper end of the valve rod 66 comes into contact with the outer end 6731 of the first cam face 673 to move the valve rod 66 to the lower limit position. Also in the first angular position, the second radial projection 6742 is in contact with the contact rod 690 to thereby activate the air pump 70' to draw the ambient air into the air chamber in the inflatable body 91 of the inflatable product 9 through an inflation path defined by the vent holes 710, the first air space 71, the first circular hole 7010, the conduit 672, the air inlet 733, the middle air space 731, the lower air space 734, the pump-receiving space 730, the second air space 72, the valve hole 736, the valve-receiving space 732, and the airport 74.

Figure 22:
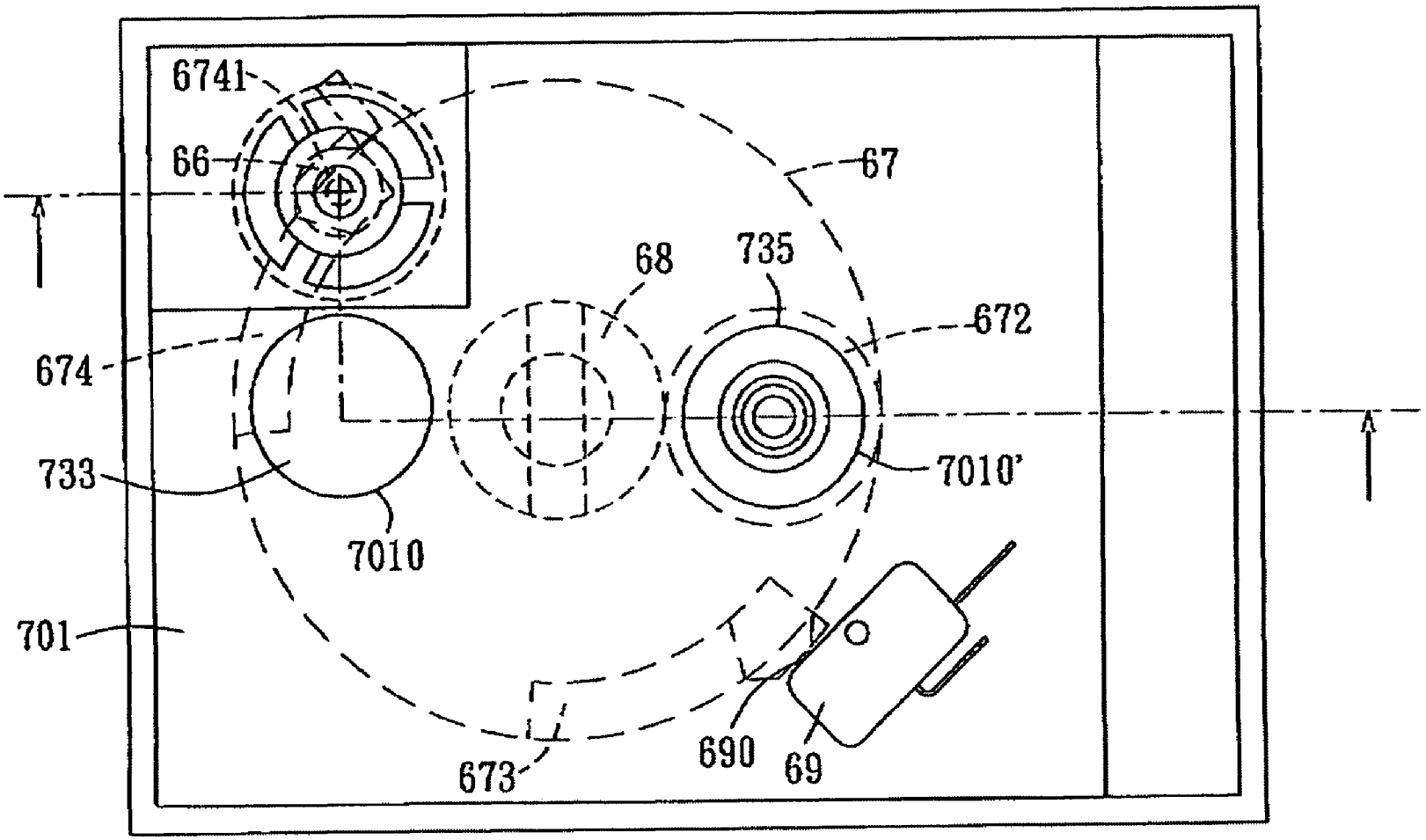
FIGS. 22 and 23 are respectively schematic top view and schematic, partly sectional side view of the controller of the fifth preferred embodiment, illustrating a deflation operation.

With particular reference to FIGS. 22 and 23, when it is desired to deflate the air chamber in the inflatable body 91 of the inflatable product 9, the rotary knob 68 is operated manually to rotate the rotary disk 67 in the second air space 72 to a second angular position, thereby aligning the conduit 672 with the air outlet 735 and the second circular hole 7010' in the housing 70. In the second angular position, the upper end of the valve rod 66 comes into contact with the outer end 6741 of the second cam face 674 to move the valve rod 66 to the lower limit position. Also in the second angular position, the first radial projection 6732 is in contact with the contact rod 690 to thereby activate the air pump 70' to force air to flow from the air chamber in the inflatable body 91 of the inflatable product 9 into the ambient through a deflation path defined by the airport 74, the valve-receiving space 732, the valve hole 736, the second air space 72, the middle air space 731, the lower air space 734, the pump-receiving space 730, the air outlet 735, the conduit 672, the second circular hole 7010', the first air space 71, and the vent holes 710.

Figure 12:
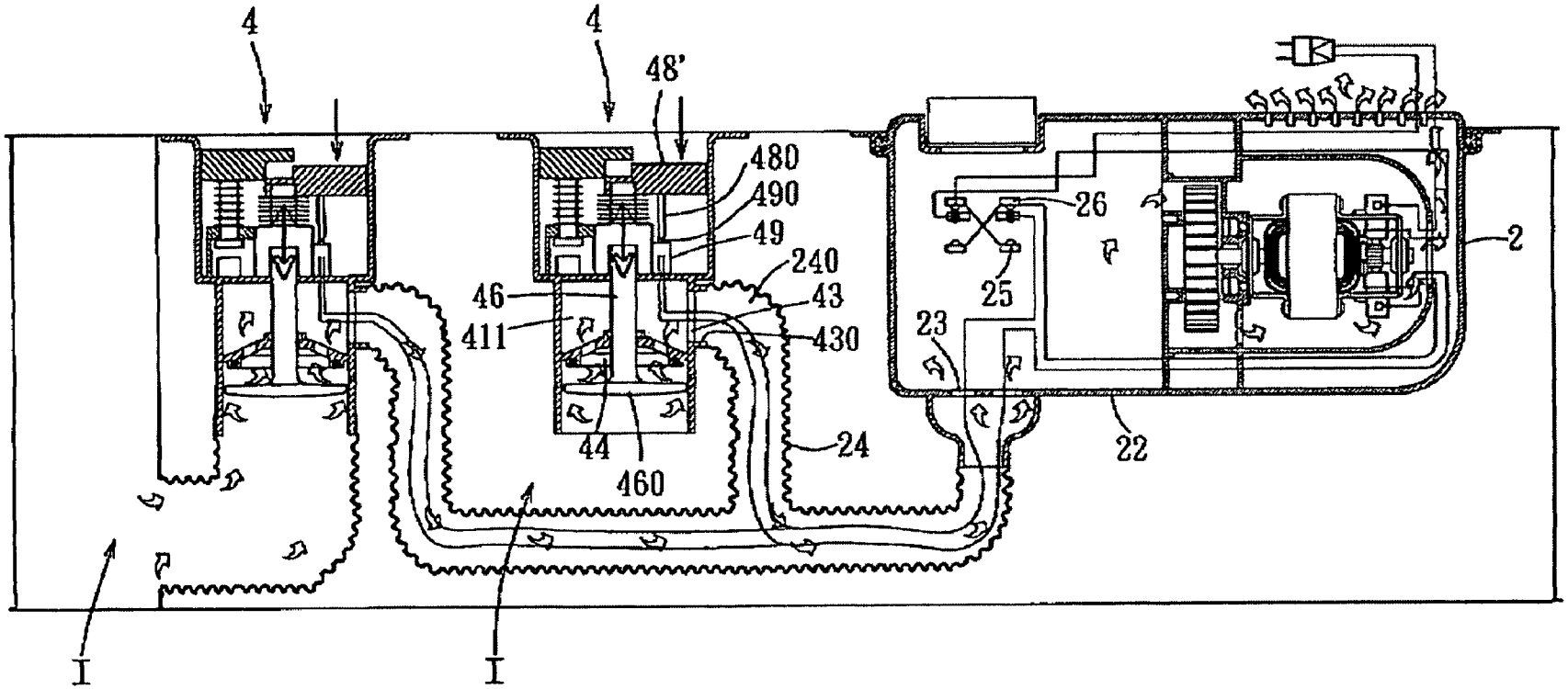
FIG. 12 is a schematic, partly sectional side view of the third preferred embodiment, illustrating how a deflation operation is performed by opening a second airport and subsequently activating an electrical air pump unit.

As shown in FIG. 12, in the electrical air pump assembly of this invention, a plurality of second airports 44 can be formed respectively in a plurality of controllers 4 to be in fluid communication with a plurality of air chambers (I) in the inflatable body 91 of the inflatable product 9, respectively. Since the electrical air pump assembly is operable manually to perform inflation, partial deflation, and full deflation of a selected one or selected ones of the air chambers (I), different levels of softness can be obtained at different areas of the inflatable product 9. Thus, the object of this invention can be achieved.

With this invention thus explained, it is apparent that numerous modifications and variations can be made without departing from the scope and spirit of this invention. It is therefore intended that this invention be limited only as indicated by the appended claims.

We claim:

1. An electrical air pump assembly adapted for use with an inflatable product, the inflatable product having an inflatable body having an exterior wall formed with at least one air chamber therein, said electrical air pump assembly comprising:

at least one electrical air pump unit;

an air tube; and at least one controller;

wherein said at least one electrical air pump unit has at least one air inlet and at least one air outlet, and said at least one controller has a first airport in fluid communication with said at least one air outlet in said at least one electrical air pump unit, and a second airport adapted to be in fluid communication with the at least one air chamber in the inflatable body, said at least one controller being operable to allow and interrupt fluid communication between said at least one electrical air pump unit and said at least one air chamber in the inflatable body;

wherein said at least one controller includes an electrical switch connected electrically to said at least one electrical air pump unit, said at least one controller being operable manually to activate said at least one electrical air pump unit so as to perform at least one of inflation, full deflation, or partial deflation of the at least one air chamber in the inflatable body;

wherein said air tube is in fluid communication with said first airport in said at least one controller and said at least one air outlet in said at least one electrical air pump unit; and wherein said at least one controller includes:

a housing defining an accommodating space and having an opening, said first airport, said second airport, and a partition disposed fixedly in said housing in a manner that divides said accommodating space into a first accommodating chamber in fluid communication with said opening, and a second accommodating chamber in fluid communication with said first and second airports;

a valve rod extending movably through said partition;

a valve being fixed to a lower end of said valve rod and movable to open and close said second airport;

a push plate connected to said valve rod in a manner that allows for synchronous movement of said push plate and said valve rod and movable in said housing to a first plate position and a second plate position; and a push rod extending from said push plate toward said electrical switch, said push rod being spaced apart from said electrical switch when said push plate is disposed in the first plate position, said push rod contacting said electrical switch to activate said at least one electrical air pump unit when said push plate is disposed in the second position.

2. The electrical air pump assembly as claimed in claim 1, wherein said at least one electrical air pump unit includes a bidirectional pump to selectively inflate and deflate the at least one air chamber when activated.

3. The electrical air pump assembly as claimed in claim 1, wherein:

said push plate is formed with an integral engaging projection; and said at least one controller further includes:

a mounting member disposed fixedly on and above said partition and in said upper first accommodating chamber and formed with a hole therethrough, a movable rod extending movably through said hole in said mounting member and formed with an outward flange extending radially and outwardly from a lower end thereof, an auxiliary plate being fixed to an upper end of said movable rod and formed with an integral pressing projection abutting against and disposed above said engaging projection of said push plate so as to allow for synchronous movement of said push plate and said auxiliary plate when said auxiliary plate is depressed, a resilient member sleeved on said movable rod and disposed between said mounting member and said auxiliary plate for biasing said outward flange to abut against said mounting member, and a stop member fixed on and above said partition and under said outward flange, said stop member being spaced apart from said outward flange by a predetermined distance such that, when said outward flange is moved downwardly to contact said stop member, said push rod is spaced apart from said electrical switch;

whereby, said electrical switch can be activated through operation of only said push plate.

4. The electrical air pump assembly as claimed in claim 1, wherein said at least one electrical air pump unit includes a bidirectional pump, a changeover switch for controlling a rotational direction of said bidirectional pump, and a power switch for controlling power supply to said bidirectional pump.

5. The electrical air pump assembly as claimed in claim 4, wherein said electrical switch further includes a control case, said changeover switch and said power switch being disposed on said control case.

6. The electrical air pump assembly as claimed in claim 1, wherein said at least one controller is built in said inflatable body, and has a portion exposed to outside outwardly of said inflatable body.

* * * * *